US011910850B2

(12) United States Patent
Yanagisawa et al.

(10) Patent No.: US 11,910,850 B2
(45) Date of Patent: Feb. 27, 2024

(54) WEARABLE AIRBAG DEVICE

(71) Applicant: TOYODA GOSEI CO., LTD., Kiyosu (JP)

(72) Inventors: Toshihito Yanagisawa, Kiyosu (JP); Wataru Miura, Kiyosu (JP); Hitomi Takahashi, Kiyosu (JP); Yusuke Kawamura, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 117 days.

(21) Appl. No.: 17/412,800

(22) Filed: Aug. 26, 2021

(65) Prior Publication Data

US 2022/0095709 A1 Mar. 31, 2022

(30) Foreign Application Priority Data

Sep. 30, 2020 (JP) ..... 2020-165663

(51) Int. Cl.
*A41D 13/018* (2006.01)

(52) U.S. Cl.
CPC ..... *A41D 13/018* (2013.01)

(58) Field of Classification Search
CPC ..... A41D 13/018; A41D 13/015; A41D 13/0506; A41D 13/05; A41D 13/0155
See application file for complete search history.

(56) References Cited

U.S. PATENT DOCUMENTS 5,366,242 A * 11/1994 Faigle ..... B60R 21/01512 280/739
5,500,952 A * 3/1996 Keyes ..... A41D 13/018 2/908

(Continued)

FOREIGN PATENT DOCUMENTS

DE 10251483 A1 * 5/2004 ..... B60R 21/276
JP 2000-317002 A 11/2000

(Continued)

OTHER PUBLICATIONS

Machine translation of DE10251483. (Year: 2004).*

(Continued)

*Primary Examiner* — Khoa D Huynh
*Assistant Examiner* — Uyen T Nguyen
(74) *Attorney, Agent, or Firm* — POSZ LAW GROUP, PLC

(57) ABSTRACT

A wearable airbag device adapted to be worn by a wearer is disclosed, including a gas generator that is configured to be actuated at fall of the wearer, an airbag that includes a plurality of inflatable portions that are partitioned from one another, the plurality of inflatable portions each including an gas inlet port and being configured to be inflated with an inflation gas fed from the gas generator via the gas inlet port for protecting a targeted body part of the wearer, and a gas switching mechanism that is disposed in a pathway of the inflation gas from the gas generator toward the plurality of inflatable portions, the gas switching mechanism being configured to switch a destination of the inflation gas emitted from the gas generator over to only one inflatable portion disposed in a falling direction of the wearer out of the plurality of inflatable portions.

2 Claims, 29 Drawing Sheets

(56) References Cited

U.S. PATENT DOCUMENTS 5,867,842 A * 2/1999 Pinsley ..... A41D 13/018 2/463
6,340,174 B1 * 1/2002 Takagi ..... B60R 21/261 280/736
6,616,177 B2 * 9/2003 Thomas ..... B60R 21/233 280/736
7,681,913 B2 * 3/2010 Thomas ..... B60R 21/276 280/739
2001/0038201 A1 * 11/2001 Ryan ..... B60R 21/276 280/742
2003/0025309 A1 * 2/2003 Schenck ..... B60R 21/276 280/739
2004/0232675 A1 * 11/2004 Marotzke ..... B60R 21/276 280/739
2005/0067816 A1 * 3/2005 Buckman ..... A61B 5/6805 280/730.1
2006/0049950 A1 * 3/2006 Lockhart ..... G08B 21/0446 340/573.1
2006/0288464 A1 * 12/2006 Warden ..... A41D 13/018 2/69
2007/0194561 A1 * 8/2007 Thomas ..... B60R 21/2338 280/736
2009/0194979 A1 * 8/2009 Bacher ..... B60R 21/276 280/728.3
2009/0224518 A1 * 9/2009 Lim ..... B60R 21/26 280/728.3
2012/0131718 A1 5/2012 Uchida et al.
2015/0101112 A1 * 4/2015 Balbien ..... A41D 13/018 2/455
2018/0140875 A1 * 5/2018 Navez ..... A63B 29/021
2018/0215339 A1 * 8/2018 Nakanishi ..... B60R 21/239

FOREIGN PATENT DOCUMENTS

WO 2010/090317 A1 8/2010
WO 2019/207474 A1 10/2019

OTHER PUBLICATIONS

Office Action dated May 30, 2023 issued in corresponding Japanese Patent Application No. 2020-165663 (and English machine translation).

* cited by examiner

Sectional View at XIX–XIX

WEARABLE AIRBAG DEVICE

CROSS REFERENCE TO RELATED APPLICATIONS

The present application claims priority from Japanese Patent Application No. 2020-165663 of Yanagisawa et al., filed on Sep. 30, 2020, the entire disclosure of which is incorporated herein by reference.

BACKGROUND

1. Technical Field

The present disclosure relates to a wearable airbag device that is adapted to be worn by a wearer and configured to deploy an airbag in order to protect one or more body parts of the wearer in the event of a fall of the wearer.

2. Description of Related Art

JP 2000-317002 A and WO 2010/090317 A1 disclose a wearable airbag device that is configured to deploy a plurality of airbags in order to protect such body parts as the hip, head, and sides, respectively, when sensing a fall of the wearer (an elderly person, by way of example) by an acceleration sensor and an angular velocity sensor. The airbags are configured to be inflated by an inflation gas fed by a gas generator. WO2019/207474 A1 discloses a wearable airbag device that includes an airbag and a gas generator for inflating the airbag, and is configured to deploy the airbag so that the airbag encircles the hip of the wearer.

A wearable airbag device with a plurality of airbags as taught in the two former references referred to above would require the number of gas generators corresponding to the number of the airbags. Such a device would resultingly be heavy and bulky, thus has a room for improvement to be implemented as a wearable airbag device. On the other hand, in a wearable airbag device that includes one each airbag and gas generator in order to deploy the airbag around the hip as taught in the latter reference, the gas generator would need to have a high gas output because the airbag would have a big volume. Such an airbag device also has a room for improvement to be implemented as an airbag device to be worn by a wearer.

Therefore, it would be desirable to provide a wearable airbag device a gas generator used in which is small and light in weight.

SUMMARY

A first wearable airbag device of the present disclosure is adapted to be worn by a wearer and configured to be actuated at fall of the wearer. The wearable airbag device includes: a gas generator; an airbag that includes a plurality of inflatable portions that are partitioned from one another, the plurality of inflatable portions each including a gas inlet port and being configured to be inflated with an inflation gas fed from the gas generator via the gas inlet port for protecting a targeted body part of the wearer; and a gas switching mechanism that is disposed in a pathway of the inflation gas from the gas generator toward the plurality of inflatable portions, the gas switching mechanism being configured to switch a destination of the inflation gas emitted from the gas generator over to only one inflatable portion disposed in a falling direction of the wearer out of the plurality of inflatable portions.

A second wearable airbag device of this disclosure that is adapted to be worn by a wearer and configured to be actuated at fall of the wearer includes a gas generator, and an airbag that includes a plurality of inflatable portions each of which is configured to be inflated with an inflation gas fed from the gas generator for protecting a targeted body part of the wearer. The plurality of inflatable portions each includes a thickness-regulating means that limits a thickness of the inflatable portion as inflated.

A third wearable airbag device of this disclosure that is adapted to be worn by a wearer and configured to be actuated at fall of the wearer includes a gas generator and an airbag that includes an outer bag and a plurality of inflatable portions that are stored in the outer bag. The plurality of inflatable portions is each configured to be inflated with an inflation gas fed from the gas generator for protecting a targeted body part of the wearer. Each of the inflatable portions includes a plurality of inner bags each of which is configured to be inflated with the inflation gas fed from the gas generator. The plurality of inner bags each includes a terminal inflatable portion in a vicinity of a leading end thereof so that the terminal inflatable portions of the plurality of inner bags are disposed side by side at airbag deployment in order to protect the targeted body part in each of the plurality of inflatable portions.

A fourth wearable airbag device that is adapted to be worn by a wearer and configured to be actuated at fall of the wearer includes a gas generator, and an airbag that includes a plurality of inflatable portions each of which is configured to be inflated with an inflation gas fed from the gas generator for protecting a targeted body part of the wearer. The gas generator is stored inside the airbag.

DETAILED DESCRIPTION

Figure 1B:
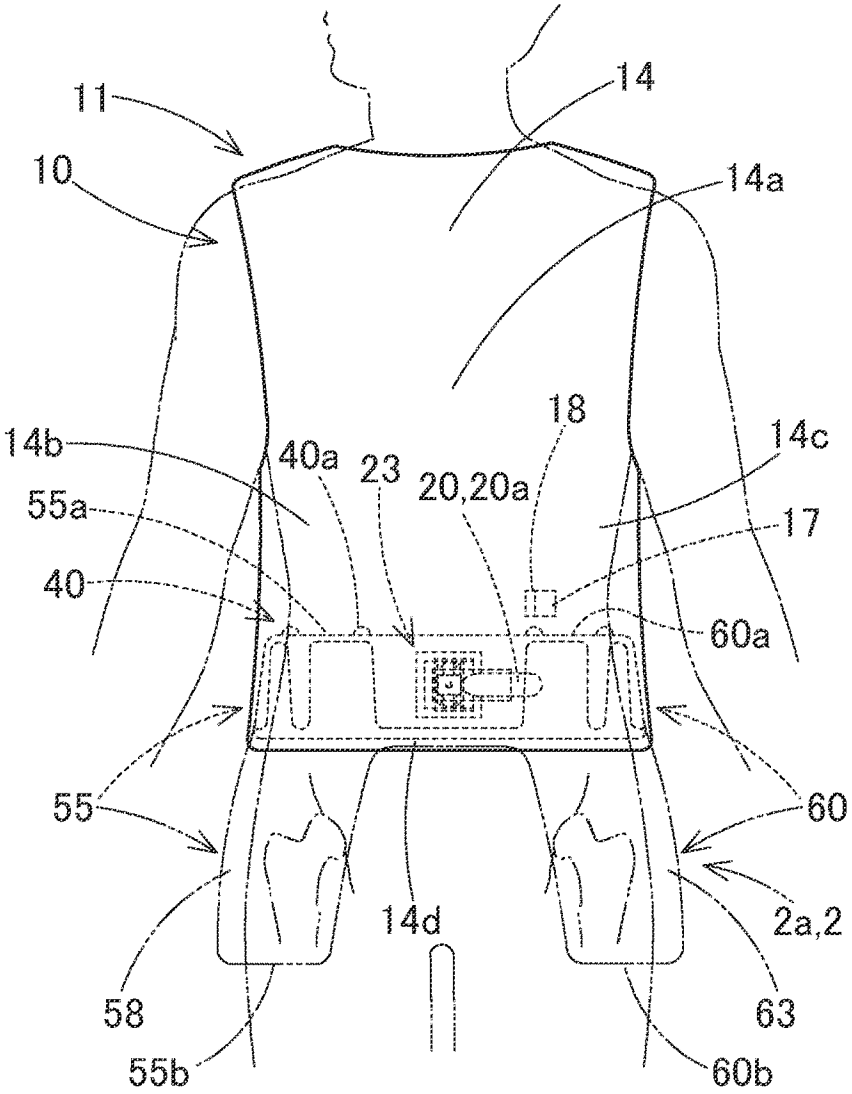
FIG. 1B is a schematic back view of the wearable airbag device of FIG. 1A.
Figure 1A:
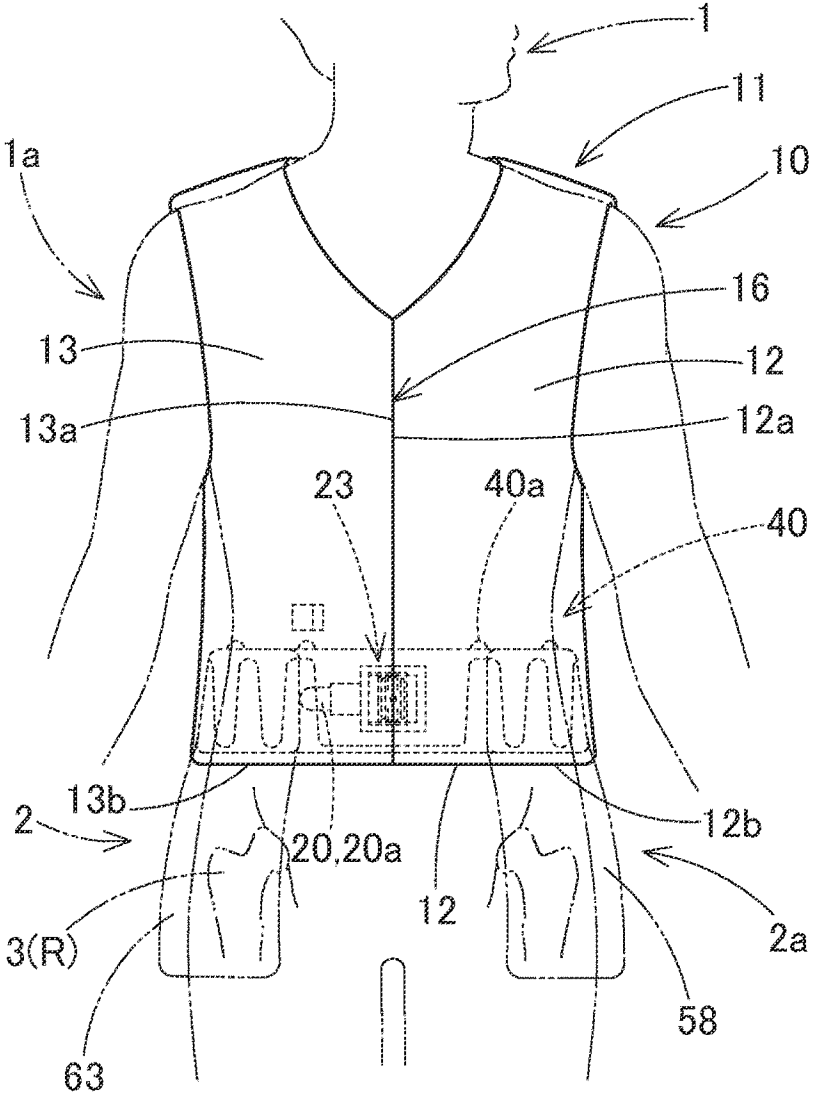
FIG. 1A is a schematic front view of a wearable airbag device in accordance with the first exemplary embodiment.
Figure 2:
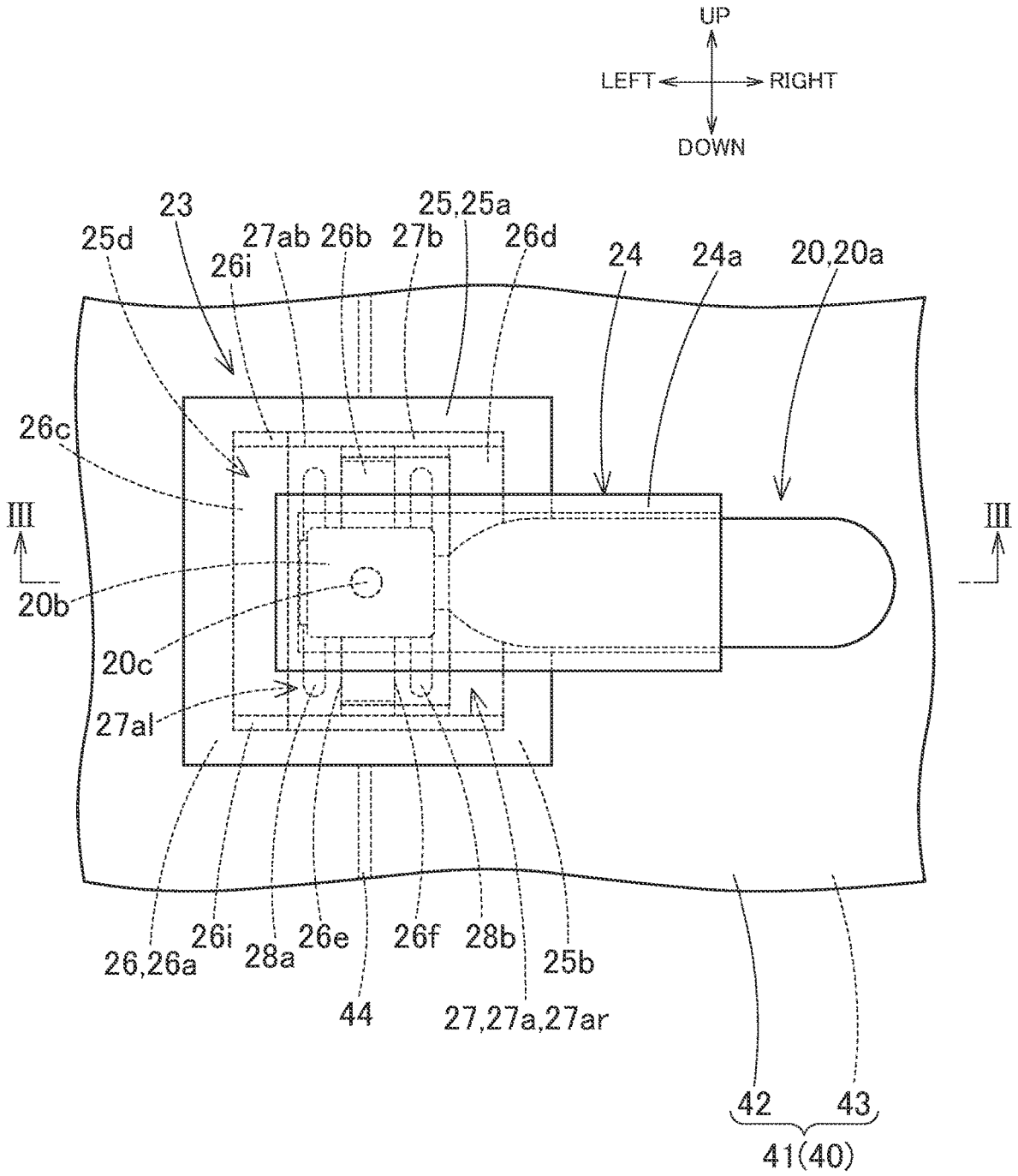
FIG. 2 is a schematic back view of a gas switching mechanism for use in the wearable airbag device in accordance with the first exemplary embodiment.

Exemplary embodiments of the present disclosure are described below with reference to the accompanying drawings. However, the invention is not limited to the embodiments disclosed herein. All modifications within the appended claims and equivalents relative thereto are intended to be encompassed in the scope of the claims.

Referring to FIGS. 1A to 6, a wearable airbag device 10 in accordance with the first exemplary embodiment includes a gas generator 20, an airbag 40 inflatable with an inflation gas G fed from the gas generator 20, an operation control device 17 that includes a sensor part 18 for detecting a fall of the wearer 1 and is configured to actuate the gas generator 20, and a holding body 11 that is formed into a vest and holds the gas generator 20, the airbag 40 and the operation control device 17. The wearable airbag device 10 further includes a gas switching mechanism 23 that is disposed at a joint of the gas generator 20 to the airbag 40.

The holding body 11 is formed into a vest that is wearable on the upper body 1*a*. The holding body 11 includes a left front portion 12 and a right front portion 13 for covering the front side of the upper body 1*a* of the wearer 1 in combination, a back portion 14 for covering the back of the upper body 1*a* of the wearer 1, and a fastening member 16 such as a zipper for fastening the inner edges 12*a* and 13*a* of the left front portion 12 and the right front portion 13 together. In other words, the left front portion 12 adjoins the back portion 14 on the front side of the left portion 14*b* of the back portion 14, and the right front portion 13 adjoins the back portion 14 on the front side of the right portion 14*c* of the back portion 14.

The operation control device 17 includes a sensor part 18 that includes an angular velocity sensor capable of sensing angular velocities around three axes in up and down, front and rear, and left and right directions, and an acceleration sensor capable of sensing accelerations in the three-axis directions. The operation control device 17 is configured to actuate the gas generator 20 in response to a signal fed from the sensor part 18 which has sensed a falling behavior different from a normal behavior of the wearer 1. More particularly, the operation control device 17 includes a determining means that is configured to determine based on various thresholds, and is configured to actuate the gas generator 20 upon sensing a fall of the wearer 1 based on the determination by the determining means. The operation control device 17 further includes a power source composed of a not-shown battery or the like for operation of the sensor part 18 and for emission of an actuating signal to the gas generator 20.

The operation control device 17 is stored in a not-shown cover or the like and disposed in a lower portion 14*d* of and on an inner surface of the right portion 14*c* in the back portion 14 of the holding body 11 so as not to be engaged with the clothing of the wearer 1, as can be seen in FIG. 1B.

The gas generator 20 includes a substantially cylindrical main body 20*a* that contains an inflation gas G composed of carbon dioxide or the like in a compressed state, a gas discharge portion 20*b* that is disposed at the leading end of the main body 20*a* and has a smaller diameter than the main body 20*a*, the gas discharge portion 20*b* including one discharge port 20*c* for discharging the inflation gas G, a not-shown initiator that is disposed in a vicinity of the boundary between the main body 20*a* and gas discharge portion 20*b*, and a not-shown burst disc. The gas generator 20 is designed to actuate the initiator to break the burst disc so that the inflation gas G is discharged from the discharge port 20*c* of the gas discharge portion 20*b* when fed with an actuating signal from the operation control device 17 that has sensed a fall of the wearer 1.

Figure 3A:
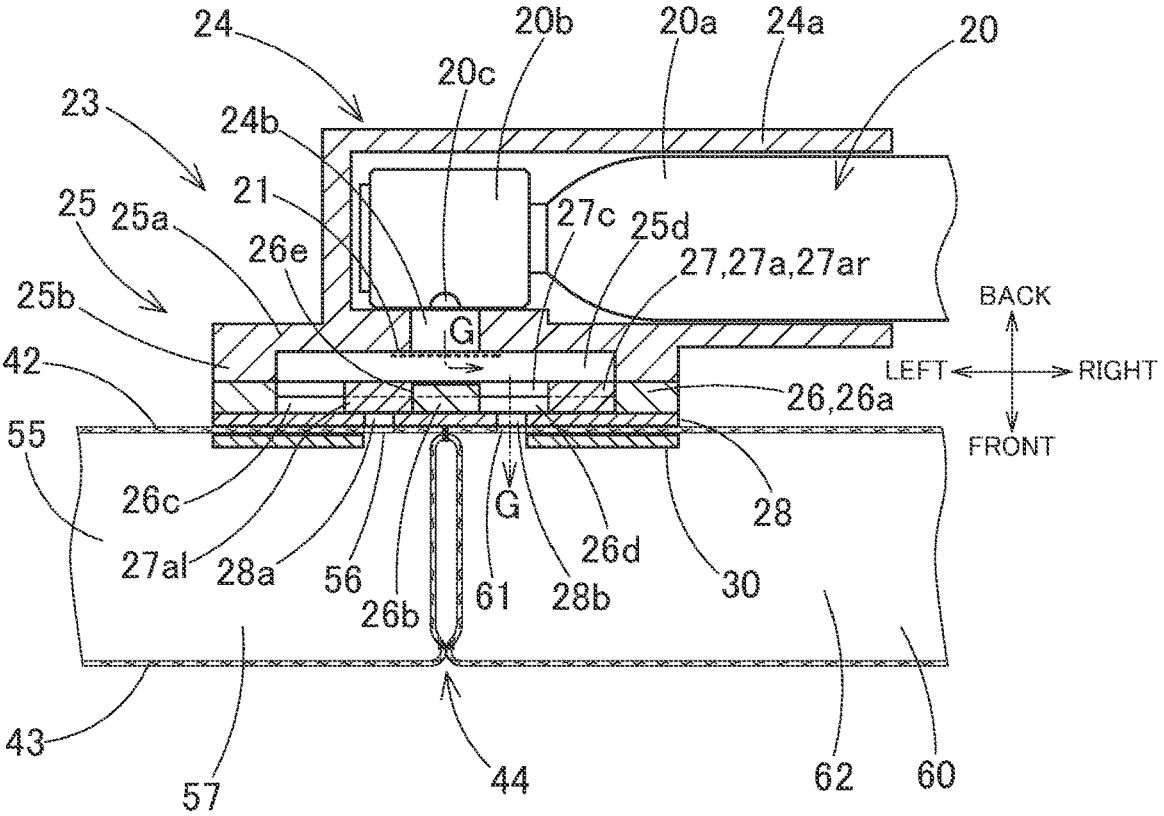
FIG. 3A is a schematic sectional view taken along line III-III of FIG. 2 showing the first mode of operation of the gas switching mechanism of the first exemplary embodiment.
Figure 3B:
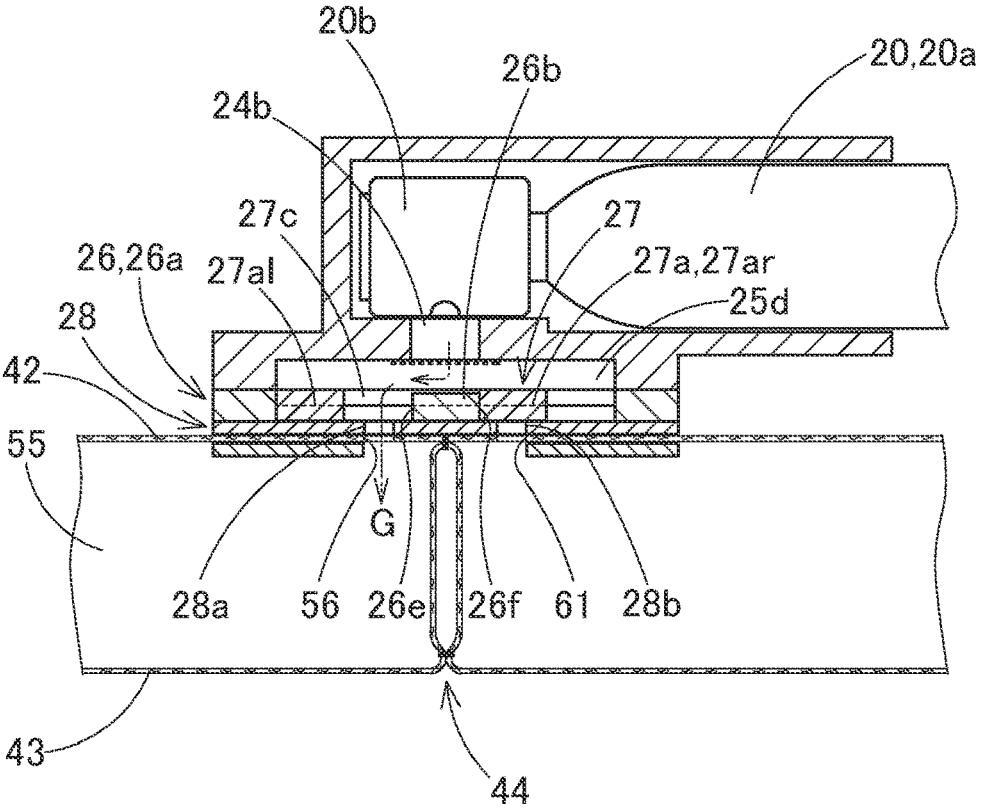
FIG. 3B is a schematic sectional view taken along line III-III of FIG. 2 showing the second mode of operation of the gas switching mechanism of the first exemplary embodiment.
Figure 5A:
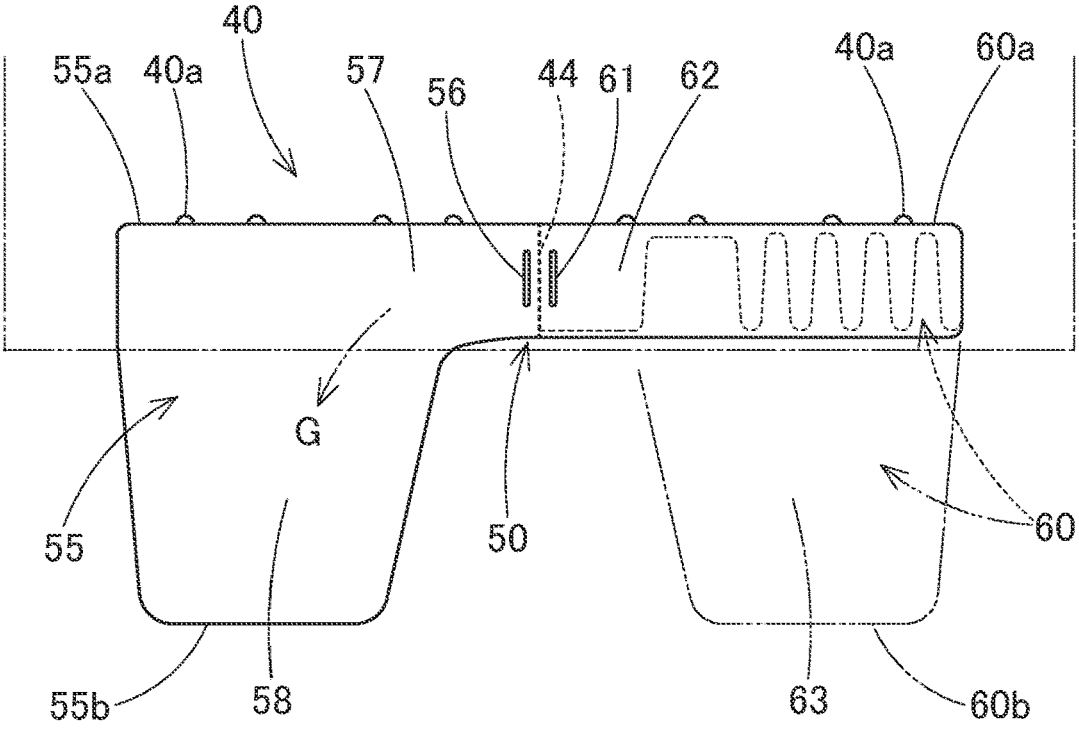
FIG. 5A is a developed view of an airbag for use in the wearable airbag device in accordance with the first exemplary embodiment as deployed.

The airbag 40 is formed of a woven fabric of polyester, polyamide or the like into a bag by sewing, OPW technology or the like, and has been subjected to gastight processing. An outer shell 41 of the airbag 40 includes an outer wall 42 that is configured to face away from the wearer 1 at airbag deployment, and an inner wall 43 that is configured to face the wearer 1 at airbag deployment. The outer wall 42 and the inner wall 43 are substantially identical in outer shape. The airbag 40 includes two inflatable portions 55 and 60 in the left side and right side, and a connecting portion 50 that connects the inflatable portions 55 and 60 at the center in a left and right direction of the back portion 14 of the holding body 11. As can be seen in FIGS. 3A, 3B and 5A, the connecting portion 50 is provided with a partition wall 44 that partitions the left inflatable portions 55 from the right inflatable portion 60 so as to prohibit gas communication between the inflatable portion 55 and inflatable portion 60. The partition wall 44 is jointed to the outer wall 42 and inner wall 43.

The partition wall 44 of this specific embodiment is composed of a part of the inner wall 43. Alternatively, however, the partition wall 44 may be composed of a part of the outer wall 42 or may be formed by connecting a separate cloth member to the outer wall 42 and inner wall 43.

Figure 5B:
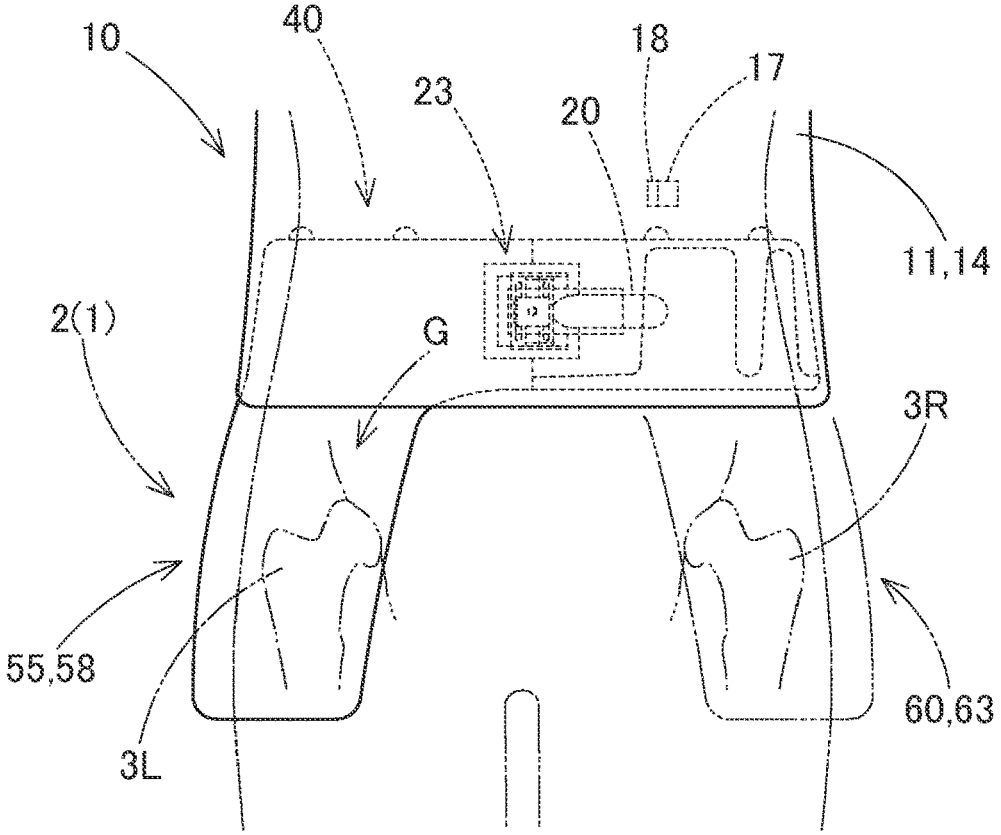
FIG. 5B is a schematic back view of the airbag of FIG. 5A as deployed in a worn state.

Each of the inflatable portions 55 and 60 includes, in a vicinity of the partition wall 44 in the outer wall 42, an inlet port 56/61 of inflation gas G. Each of the inflatable portions 55 and 60 further includes, at the leading end, a hip-protecting portion 58/63 for protecting the left/right trochanter 3 (3L/3R) of femur as the targeted body part. Each of the hip-protecting portions 58, 63 is designed to be inflated into a substantially rectangular board that extends forward and rearward from the left/right side 2*a* of the hip 2 of the wearer 1 for covering the trochanter 3L/3R and its surroundings at airbag deployment. A portion of each of the inflatable portions 55 and 60 from a vicinity of the inlet port 56/61 to short of the hip-protecting portion 58/63 serves as a gas conduit 57/62. Each of the gas conduits 57/62 is smaller in width in an up and down direction than the hip-protecting portions 58, 63, as can be seen in FIGS. 5A and 5B.

The airbag 40 further includes, in the upper edges 55*a*, 60*a* of the inflatable portions 55, 60, a plurality of mounting tabs 40*a*. The airbag 40 is attached to the inner surface of the holding body 11 by the mounting tabs 40*a* by sewing or the like. In the airbag 40 in a standby state, each of the hip-protecting portions 58, 63 is in a folded form that was formed by folding the hip-protecting portion 58/63 in such a manner as to bring the lower edge 55*b*/60*b* close to the upper edge 55*a*/60*a*, more particularly, by invaginating the lower edge 55*b*/60*b* portion into the hip-protecting portion 58/63.

The gas switching mechanism 23 is disposed in the periphery of the inlet ports 56, 61. The gas switching mechanism 23 is configured to switch the destination of inflation gas G over to either one of the inflatable portions 55, 60 disposed in the falling direction of the wearer 1. The gas discharge portion 20*b* of the gas generator 20 is coupled to the gas switching mechanism 23. Referring to FIGS. 2 to 4B, the gas switching mechanism 23 includes a gas entrance section 24 that is coupled with the gas discharge portion 20*b*, a gas exit section 28 that is in communication with the inlet ports 56, 61 of the inflatable portions 55, 60, a slidable section 27 and a stopper 26 that is configured to position the slidable portion 27. The gas switching mechanism 23 in accordance with the first exemplary embodiment further includes a gas depot 25 that is configured to receive an inflation gas G from the gas entrance section 24 and lead the gas G toward the slidable portion 27 and the stopper 26.

The gas entrance section 24 includes an assembling tube 24*a* that is disposed at the back of the gas depot 25, receives the gas discharge portion 20*b* and holds the gas generator 20. The gas entrance section 24 includes a gas introductory port 24*b* that is in gas communication with the gas depot 25.

The gas depot 25 includes a ceiling wall 25*a* that is provided with the gas introductory port 24*b*, and a circumferential wall 25*b* that extends forward (i.e. toward the gas exit section 28 from the outer circumferential edge of the ceiling wall 25*a*) in a substantially square tubular shape. The ceiling wall 25*a* and circumferential wall 25*b* define a gas reservoir 25*d*.

The stopper 26 is fixed to an end surface of the circumferential wall 25*b* facing away from the ceiling wall 25*a*. The stopper 26 is configured to stop the slippage in a left and right direction of the slidable portion 27. The stopper 26 includes a main body 26*a* having a square frame shape identical to the circumferential wall 25*b* of the gas depot 25, and a middle portion 26*b* that is disposed at the center in the left and right direction of the main body 26*a*. A gas channel 26*c* and a gas channel 26*d* are disposed on the left side and right side of the middle portion 26*b*, respectively. Surfaces of the middle portion 26*b* facing the gas channels 26*c*, 26*d* each serve as stopper surfaces 26*e*, 26*f* that are configured to stop the sliding movement of the slidable portion 27.

Further, the main body 26*a* of the stopper 26 includes, in an upper portion and a lower portion of the inner surface, a pair of sliding grooves 26*i* that respectively receive later-described upper and lower flanges 27*ba* of the slidable portion 27 and allow the slideable portion 27 to slide therein.

As can be seen in FIGS. 3A and 3B, the gas exit section 28 is formed into a plate and disposed in front of the stopper 26. The gas exit section 28 is coupled with a holding plate 30 so that a region in the outer wall 42 of the airbag 40 in the periphery of the inlet ports 56, 61 is sandwiched between the gas exit section 28 and the holding plate 30. The gas exit section 28 includes two gas outlet ports 28*a*, 28*b* each in gas communication with the inlet port 56 and inlet port 61 of the inflatable portions 55, 60. The gas outlet port 28*a* that is in gas communication with the inlet port 56 of the left inflatable portion 55 has a smaller opening area than the left gas channel 26*c* of the stopper 26, and the gas outlet port 28*b* that is in gas communication with the inlet port 61 of the right inflatable portion 60 has a smaller opening area than the right gas channel 26*d* of the stopper 26. In other words, the left gas channel 26*c* of the stopper 26 is greater in opening area than the inlet port 56 of the airbag 40, and the right gas channel 26*d* of the stopper 26 is greater in opening area than the inlet port 61 of the airbag 40.

Figure 4A:
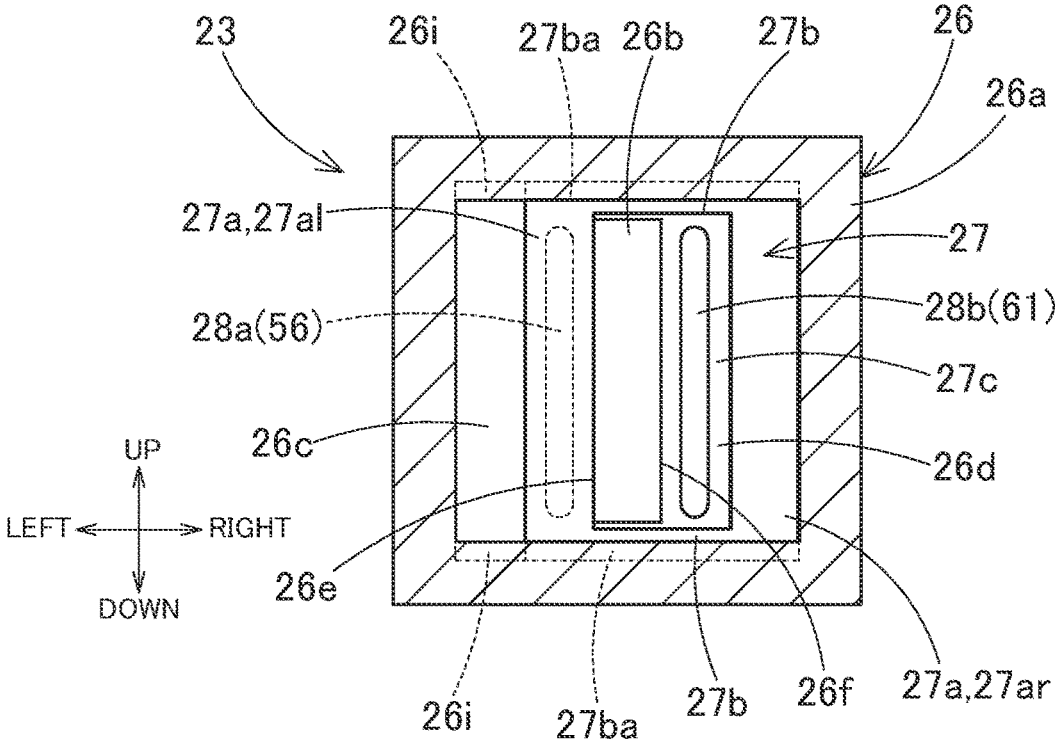
FIG. 4A schematically depicts a stopper and a slidable portion in the first mode of operation of the gas switching mechanism of the first exemplary embodiment.
Figure 4B:
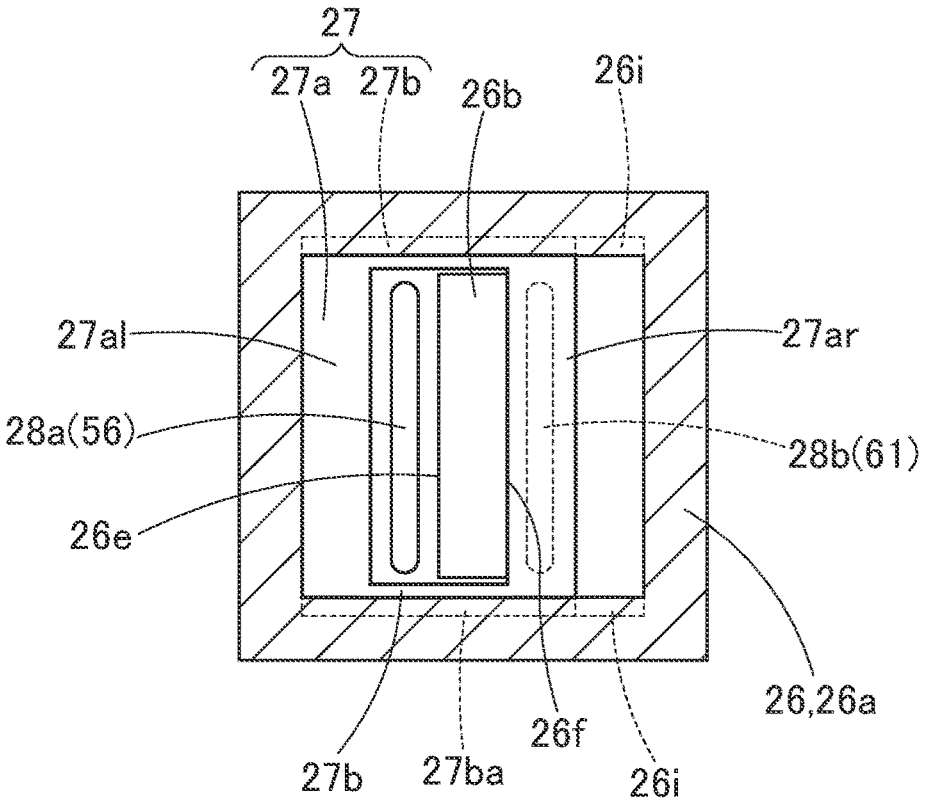
FIG. 4B schematically depicts the stopper and the slidable portion in the second mode of operation of the gas switching mechanism of the first exemplary embodiment.

The slidable portion 27 is formed into a square frame, and is disposed at the back of the gas exit section 28 inside of the main body 26*a* of the stopper 26 in such a manner as to be slidable against the gas exit section 28. The slidable portion 27 includes a pair of left and right vertical frames 27*a* extending in the up and down direction, a pair of transverse frames 27*b* each connecting upper and lower ends of the left and right vertical frames 27*a*, and a communication port 27*c* having a substantially rectangular shape and disposed at the center. One each flange 27*ba* is formed along upper and lower edges of the slidable portion 27 for sliding in the sliding grooves 26*i* of the stopper 26, as can be seen in FIGS. 4A and 4B. Each of the left and right vertical frames 27*a* of the slidable portion 27 has such a width that is capable of closing the gas outlet port 28*a*/28*b* of the gas exit section 28. The location of the left and right vertical frames 27*a* of the slidable portion 27 is arranged as follows: when the left vertical frame 27*a*1 closes the left gas outlet port 28*a*, the left vertical frame 27*a*1 abuts against and is positioned by the stopper surface 26*e* of the stopper 26 while the right vertical frame 27*ar* slides to the right of the right gas outlet port 28*b* so as to open the gas outlet 28*b* as can be seen in FIGS. 3A and 4A. To the contrary, when the right vertical frame 27*ar* closes the right gas outlet port 28*b*, the right vertical frame 27*ar* abuts against and is positioned by the stopper surface 26*f* of the stopper 26 while the left vertical frame 27*a*1 slides to the left of the left gas outlet port 28*a* so as to open the gas outlet port 28*a* as can be seen in FIGS. 3B and 4B. This sliding movement of the slidable portion 27 occurs at sideways fall of the wearer 1. The slidable portion 27 is configured to slide in the falling direction due to gravity or inertia force at fall.

The gas introductory port 24*b* of the gas switching mechanism 23 is provided with a filtering member 21 for filtering the inflation gas G. The filtering member 21 is arranged to close the gas introductory port 24*b* and configured to capture gas residue at actuation of the gas generator 20 while permitting gas passage. That is, the filtering member 21 prevents the residue from entering into the airbag 40. The filtering member 21 is formed of cloth or metal mesh material.

An assembling of the wearable airbag device 10 is now described. Firstly, the gas switching mechanism 23 is assembled with the airbag 40, then the gas generator 20 is set in the gas switching mechanism 23. Subsequently, each of the inflatable portions 55 and 60 is folded in such a manner that the lower edge 55*b*/60*b* is brought closer to the upper edge 55*a*/60*a*, then the airbag 40 is attached to the holding body 11 making use of the mounting tabs 40*a*. Then not-shown lead wires extending from the operation control device 17 which has been mounted on the holding body 11 in advance are connected to the gas generator 20. The wearable airbag device 10 is thus assembled.

Figure 6:
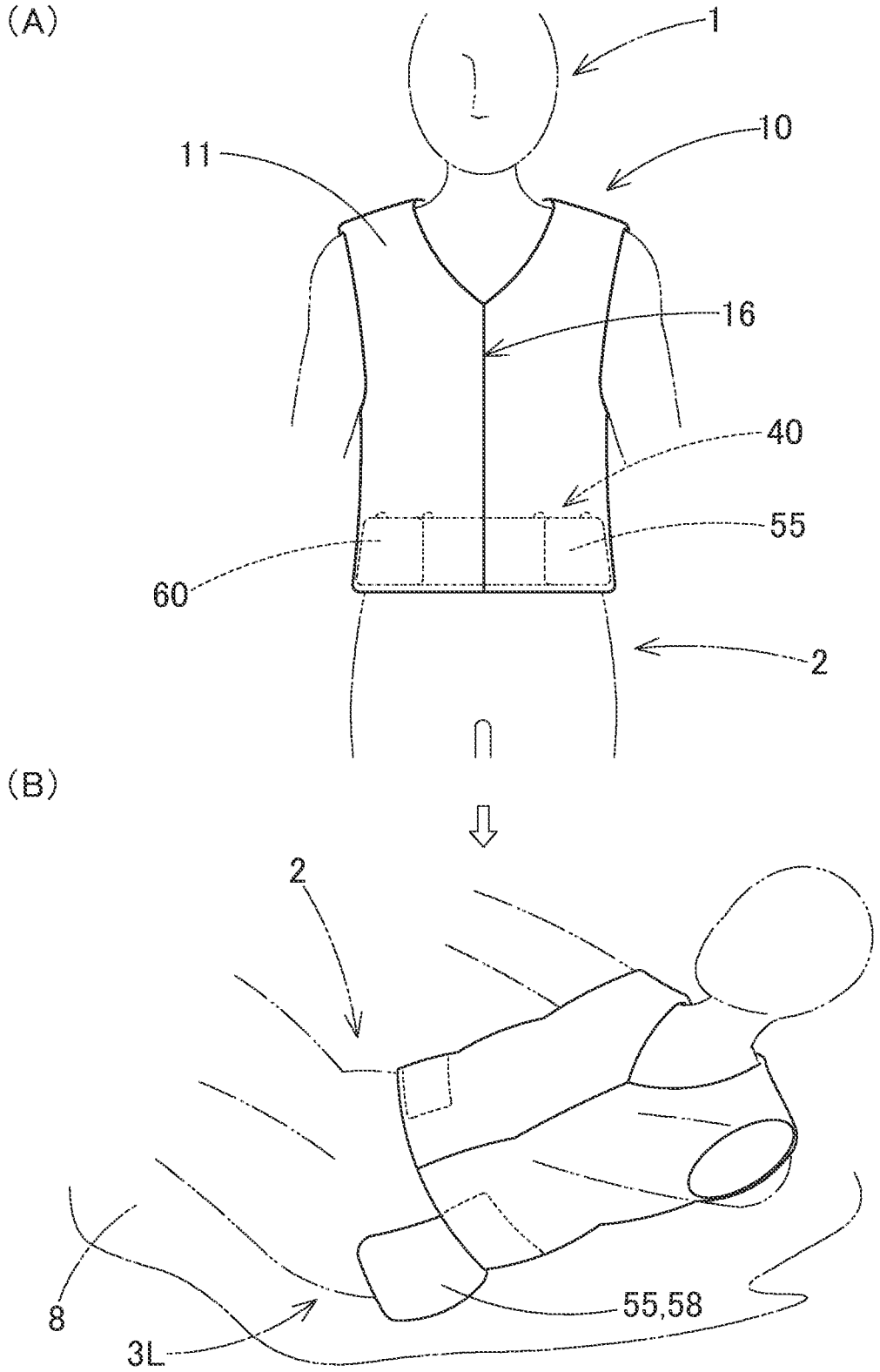
FIG. 6 illustrates the deployment process of the wearable airbag device in accordance with the first exemplary embodiment at fall of the wearer.
Figure 7:
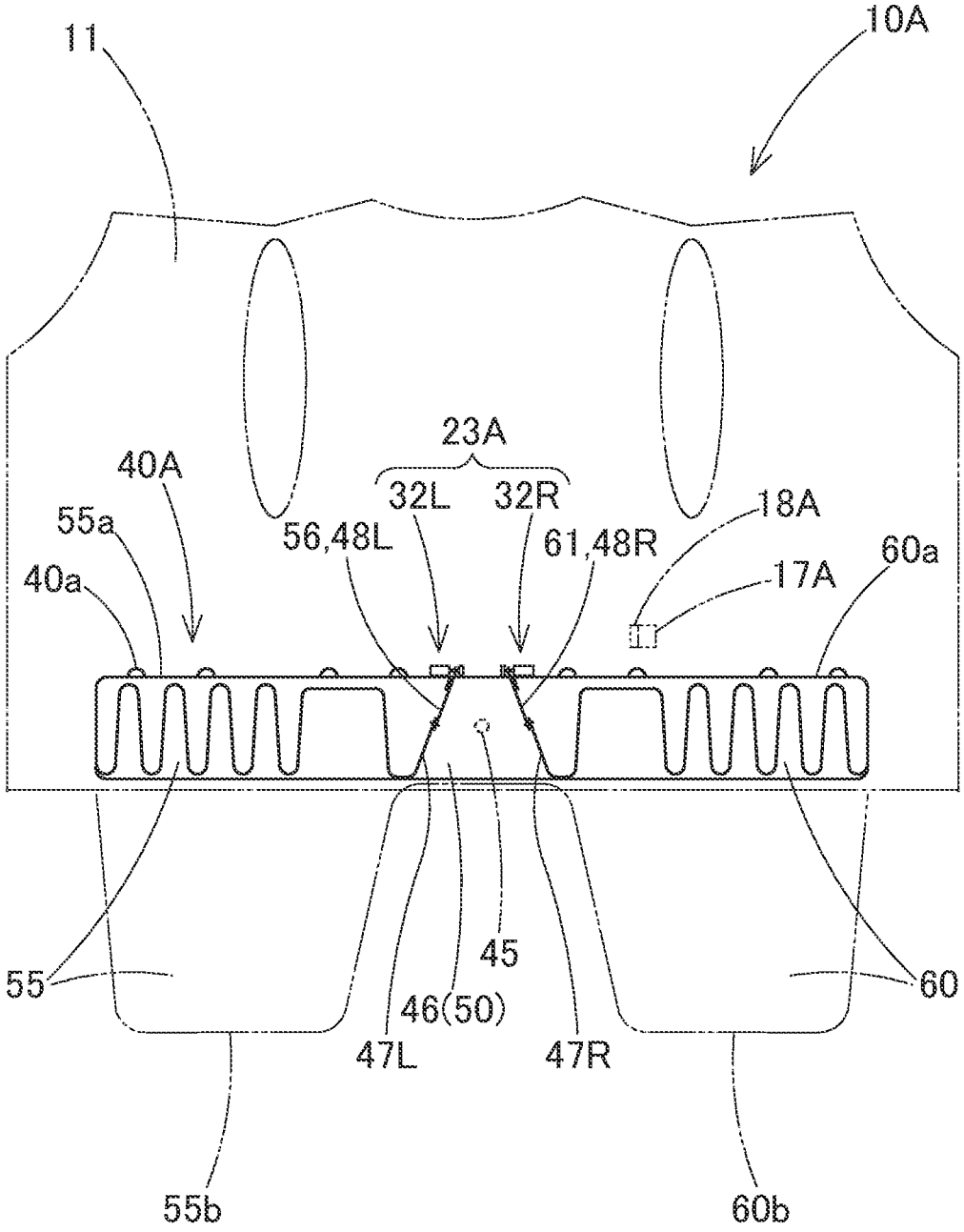
FIG. 7 is a schematic back view of a wearable airbag device in accordance with the second exemplary embodiment.

The wearer 1 puts the wearable airbag device 10 (i.e. the holding body 11) in accordance with the first exemplary embodiment on the upper body 1*a* using the fastening member 16. If the wearer 1 wearing the wearable airbag device 10 falls, the operation control device 17 actuates the gas generator 20 in response to a signal received from the sensor part 18. At this time, the slidable portion 27 of the gas switching mechanism 23 slides toward the falling direction (to the left, by way of example) of the wearer 1 against the gas exit section 28 at the back of the gas exit section 28 (on a side of the gas exit section 28 facing away from the airbag 40), so that the right vertical frame 27*ar* of the slidable portion 27 abuts against and is positioned by the stopper surface 26*f* of the stopper 26 while the left vertical frame 27*a*1 shifts to the left of the left gas outlet port 28*a* so as to open the gas outlet port 28*a* as can be seen in FIG. 4B. That is, the gas introductory port 24*b*, the gas reservoir 25*d*, the communication port 27*c*, the gas outlet port 28*a* and the inlet port 56 of the inflatable portion 55 are brought into gas communication with one another, as can be seen in FIG. 3B. Therefore, the inflation gas G discharged from the discharge port 20*c* of the gas discharge portion 20*b* of the gas generator 20 flows into the inflatable portion 55 via the gas introductory port 24*b*, the gas reservoir 25*d*, the communication port 27*c*, the gas outlet port 28*a* and the inlet port 56 of the inflatable portion 55, while the right vertical frame 27*ar* closes the other gas outlet port 28*b* which is in gas communication with the other inflatable portion 60. That is, the inflation gas G flows only into the inflatable portion 55 disposed in the falling direction of the wearer 1, so that the inflatable portion 55 secures a predetermined internal pressure and is deployed between the hip 2 and the ground 8 to protect the targeted body part 3L, as can be seen in FIGS. 5A, 5B, and 6. Since the inflation gas G does not flow into the inflatable portion 60 because of the partitioning wall 44 partitioning the inflatable portion 55 from the other inflatable portion 60, the gas generator 20 does not have to inflate both of the inflatable portions 55 and 60, but only needs a gas output enough to inflate the inflatable portion 55 only. That is, a small and light gas generator may work as the gas generator 20 for the wearable airbag device 10.

If the wearer 1 falls toward the right, in an opposite manner to the above, the slidable portion 27 slides to the right so that the right vertical frame 27*ar* shifts to the right of the right gas outlet port 28*b* so as to open the gas outlet port 28*b* which is in gas communication with the inlet port 61 of the inflatable portion 60, while the left vertical frame 27*a*1 closes the other gas outlet port 28*a* which is in gas communication with the inlet port 56 of the other inflatable portion 55, as can be seen in FIGS. 3A and 4A. Therefore, the inflation gas G flows only into the inflatable portion 60 disposed in the falling direction of the wearer 1, so that the inflatable portion 60 secures a predetermined internal pressure and is deployed between the hip 2 and the ground 8 to protect the targeted body part 3R, as indicated with dashed-and-double-dotted lines in FIGS. 5A, 5B.

Therefore, the wearable airbag device 10 in accordance with the first exemplary embodiment only needs a small and light gas generator to inflate the airbag 40.

In the wearable airbag device 10 in accordance with the first exemplary embodiment, the filtering member 21 is disposed in the pathway of inflation gas G from the gas generator 20 toward the inflatable portions 55, 60 of the airbag 40 (in a vicinity of the gas introductory port 24*b*, in this specific embodiment) in order to capture gas residue in the inflation gas G at actuation of the gas generator 20.

The filtering member 21 will prevent the residue from entering into the inflatable portion 55/60 of the airbag 40 at actuation of the gas generator 20. The filtering member 21 will further prevent problems which would possibly be caused by the residue, such as breakage of the inflatable portion 55/60 and subsequent ejection of the residue from the airbag 40.

The filtering member 21 should be disposed in the pathway of inflation gas G from the gas generator 20 toward the inflatable portions 55, 60 such as in a vicinity of the outlet ports 28*a*, 28*b* of the gas exit section 28.

In the wearable airbag device 10 in accordance with the first exemplary embodiment, the gas switching mechanism 23 includes: the gas exit section 28 that includes a plurality of gas outlet ports 28*a*, 28*b* corresponding in number to the number of the plurality of inflatable portions 55, 60, the plurality of gas outlet ports 28*a*, 28*b* each being in gas communication with the inlet port 56/61 of a corresponding one of the plurality of inflatable portions 55/60 of the airbag 40; the slidable portion 27 that is disposed on a side of the gas exit section 28 facing away from the airbag 40 and includes the communication port 27*c* and the peripheral portion (vertical frame 27*ar* or vertical frame 27*a*1) of the communication port 27*c*, the slidable portion 27 being configured to slide against the gas exit section 28 in the falling direction of the wearer 1 due to gravity so as to bring the communication port 27*c* into gas communication with one gas inlet port 28*a* or 28*b* of the plurality of gas outlet ports of the gas exit section 28 while closing the other gas outlet port 28*b* or 28*a* of the gas exit section 28 with the peripheral portion (vertical frame) 27*ar* or 27*a*1 of the communication port 27*c*; and the stopper 26 that, at sliding movement of the slidable portion 27 in the falling direction, is configured to position the slidable portion 27 at a position where the communication port 27*c* is in gas communication with the gas outlet port 28*a*/28*b* of the gas exit section 28 that is in gas communication with the inlet port 56/61 of the one inflatable portion 55/60 disposed in the falling direction, as can be seen in FIGS. 3B and 4B or in FIGS. 3A and A. The gas switching mechanism 23 further includes the gas entrance section 24 that covers the communication port 27*c* of the slidable portion 27 on a side of the slidable portion 27 facing away from the gas exit section 28, the gas entrance section 24 having gas communication with the gas discharge portion 20*b* of the gas generator 20, and being configured to lead the inflation gas G into the communication port 27*c*.

With this configuration, the destination of the inflation gas G is switched only by the sliding movement of the slidable portion 27 due to gravity, without using a sensor for sensing the falling direction and determining means.

A wearable airbag device 10A in accordance with the second exemplary embodiment is now described referring to FIGS. 7 to 10. The wearable airbag device 10A includes an operation control device 17A that is configured to control operation of the gas generator 20 and operation of a gas switching mechanism 23A. The operation control device 17A includes a sensor part 18A that is configured to sense the falling direction of the wearer 1, and is configured to operate the gas switching mechanism 23A to switch the destination of the inflation gas G based on the falling direction sensed by the sensor part 18A.

Also in the wearable airbag device 10A, the holding body 11 holds an airbag 40A, the gas generator 20, the operation control device 17A including the sensor part 18A, and the gas switching mechanism 23, similarly to the first exemplary embodiment.

The airbag 40A includes left and right inflatable portions 55 and 60 and a connecting portion 50 (which concurrently acts as a branch chamber 46 of the gas switching mechanism, as will be described later) disposed between the left and right inflatable portions 55 and 60. An inlet port 45 of inflation gas is formed on the outer wall 42 of the airbag 40A in the branch chamber 46 (i.e. in the connecting portion 50) for connection with the gas discharge portion 20*b* of the gas generator 20. The inlet port 45 is provided with a filtering member 21 for filtering the inflation gas and capturing residue in the gas.

The gas switching mechanism 23A in accordance with the second exemplary embodiment includes two actuators 32 (32L, 32R), a branch chamber 46 that adjoins the left and right inflatable portions 55 and 60, two partitioning walls 47 (47L, 47R) each of which partitions the inflatable portion 55/60 from the branch chamber 46, two openings 48 (48L, 48R) each of which is formed in the partitioning wall 47L/47R and acts as an inlet port 56/61 of the inflatable portion 55/60, and two valves 33 each of which closes the opening 48 (48L/48R) and is configured to open the opening 48 (48L/48R) by operation of the actuator 32 (32L/32R).

The branch chamber 46 is disposed between the outer wall 42 and inner wall 43, and is partitioned from both of the inflatable portion 55 and inflatable portion 60 by the partitioning walls 47 (47L, 47R). Each of the partitioning walls 47L, 47R is provided with a round opening 48L/48R at the center. Each of the openings 48L, 48R is covered by a sheet valve 33 (33L, 33R) that has flexibility and impermeable to inflation gas. Each of the valves 33 (33L, 33R) is disposed in a side of the partitioning wall 47L/47R facing the branch chamber 46. More particularly, the lower end of each of the valves 33 (33L, 33R) acts as a fixed end 33*a* that is fixed to a vicinity of the lower edge of the opening 48L/48R in the partitioning wall 47L/47R by sewing or the like. The upper end of each of the valves 33 (33L, 33R) acts as a retained end 33*b* that is taken out of the airbag 40A via a through hole 49 formed in an upper portion of the airbag 40A (or branch chamber 46) and is retained by the actuator 32 (32L, 32R). Each of the actuators 32 (32L, 32R) is composed of an electromagnetic solenoid or the like and includes a plunger 32*a* and a stopper 32*b* that retains the leading end of the plunger 32*a*. The actuator 32 is configured to withdraw the plunger 32*a* so that the leading end of the plunger 32*a* is disengaged from the stopper 32*b*, when actuated. The retained end 33*b* of each of the valves 33 is retained by the plunger 32*a* of the actuator 32 (32L, 32R). If the actuator 32 (32L/32R) is actuated and withdraw the plunger 32*a* when the branch chamber 46 is filled with the inflation gas G and has a high internal pressure, the retained end 33*b* of the valve 33 (33L/33R) is released from the plunger 32*a* and drawn into the branch chamber 46 via the through hole 49 due to pressure of the inflation gas G inside the branch chamber 46, and the valve 33 (33L/33R) is further pushed into the inflatable portion 55/60, so that the opening 48 (48L/48R), i.e. the inlet port 56/61, of the inflatable portion 55/60 opens.

Figure 8A:
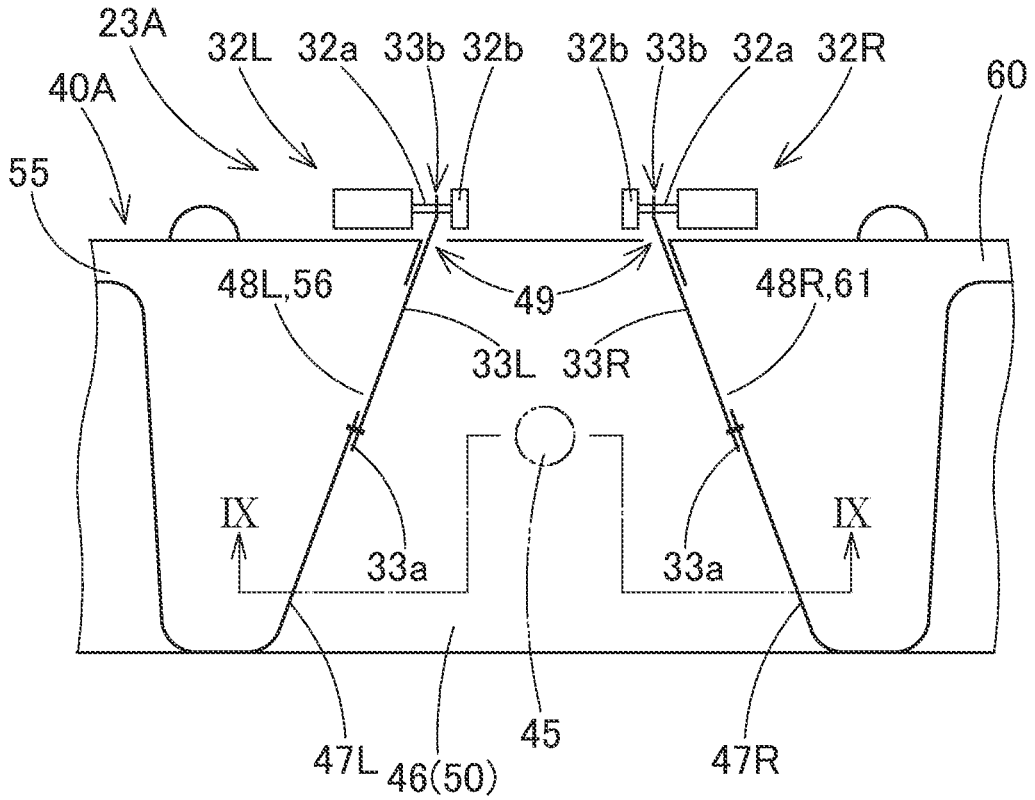
FIGS. 8A and 8B illustrate the operation of the gas switching mechanism in order.
Figure 8B:
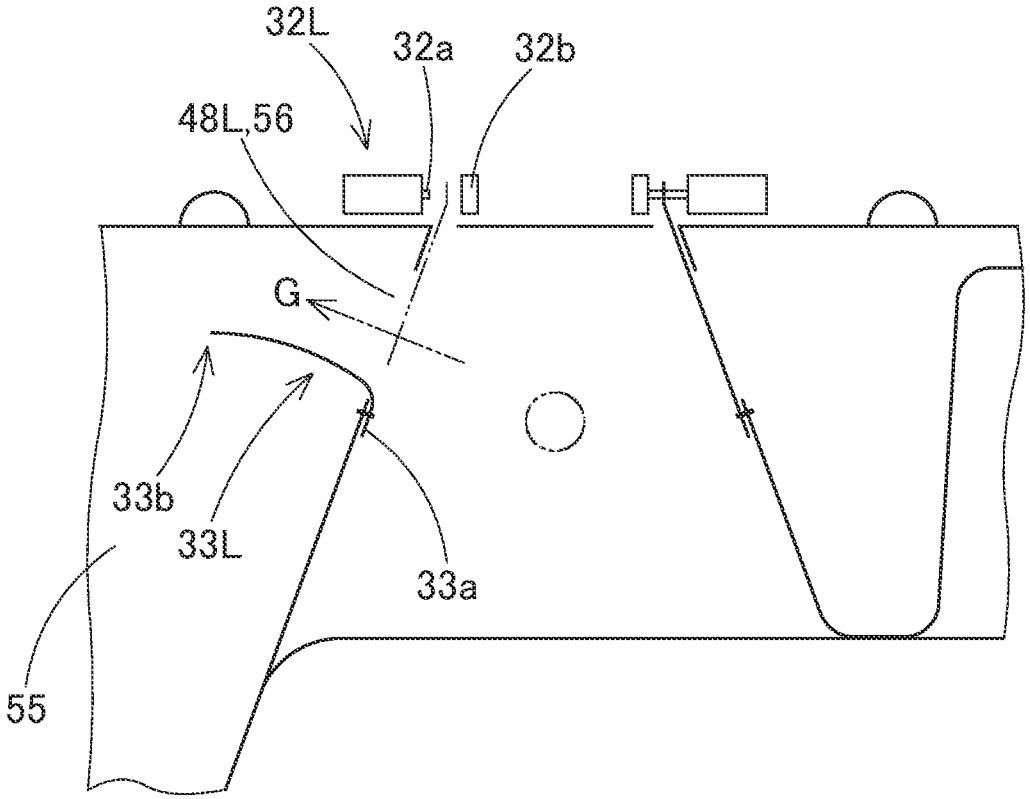
Figure 9:
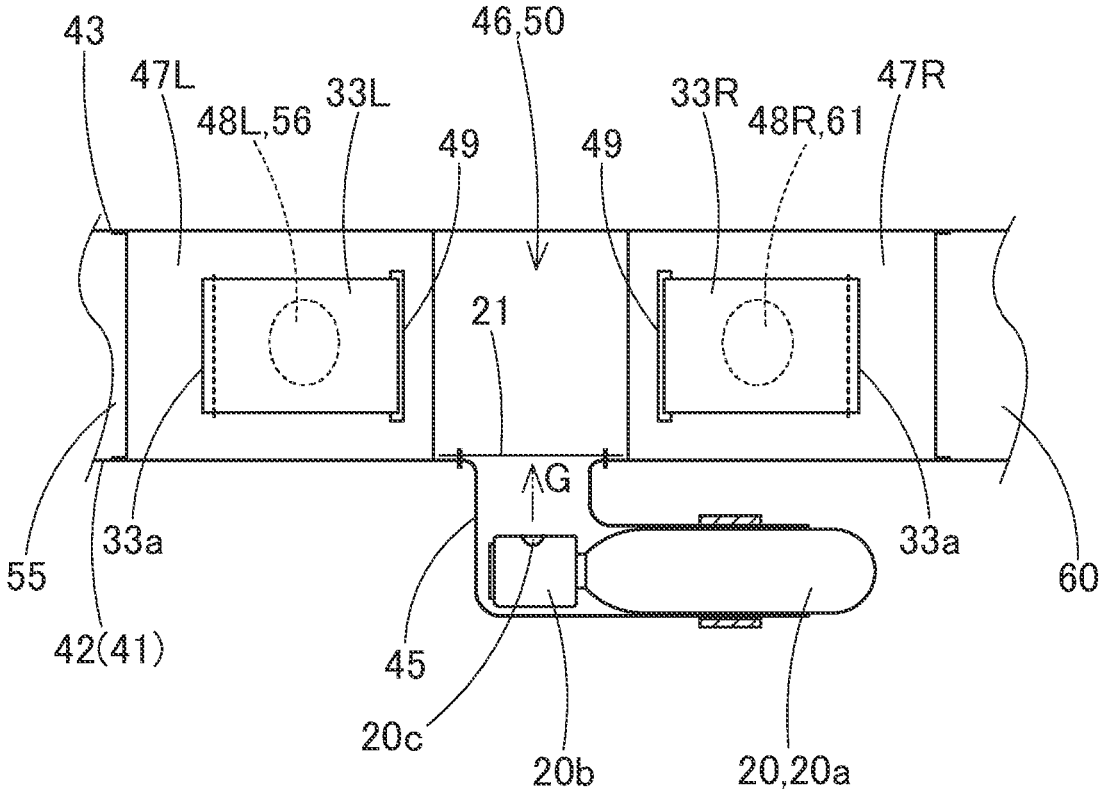
FIG. 9 is a schematic cross-sectional view taken along line IX-IX of FIG. 8.
Figure 10:
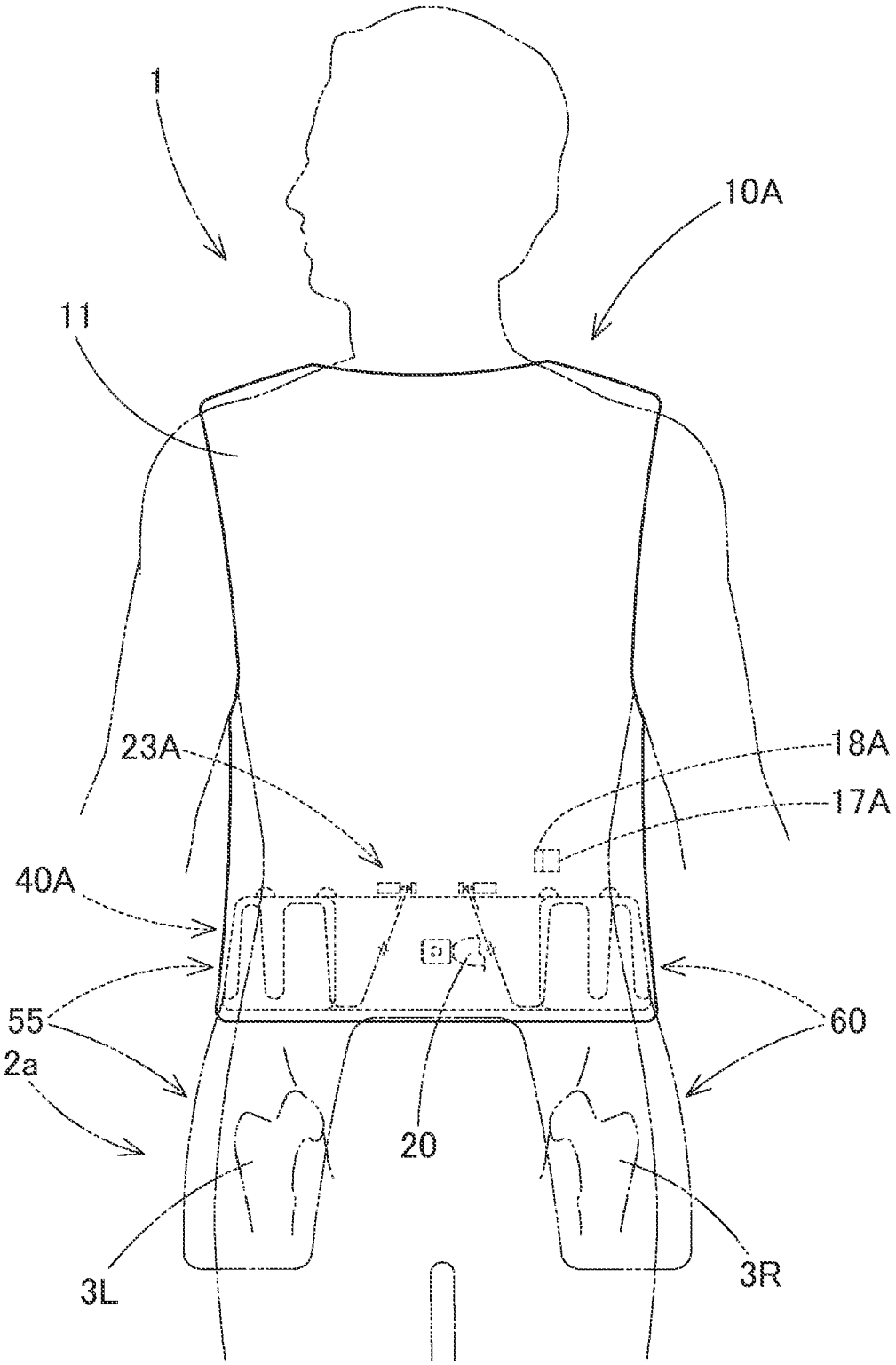
FIG. 10 is a back view of the wearable airbag device in accordance with the second exemplary embodiment as worn by the wearer.
Figure 11:
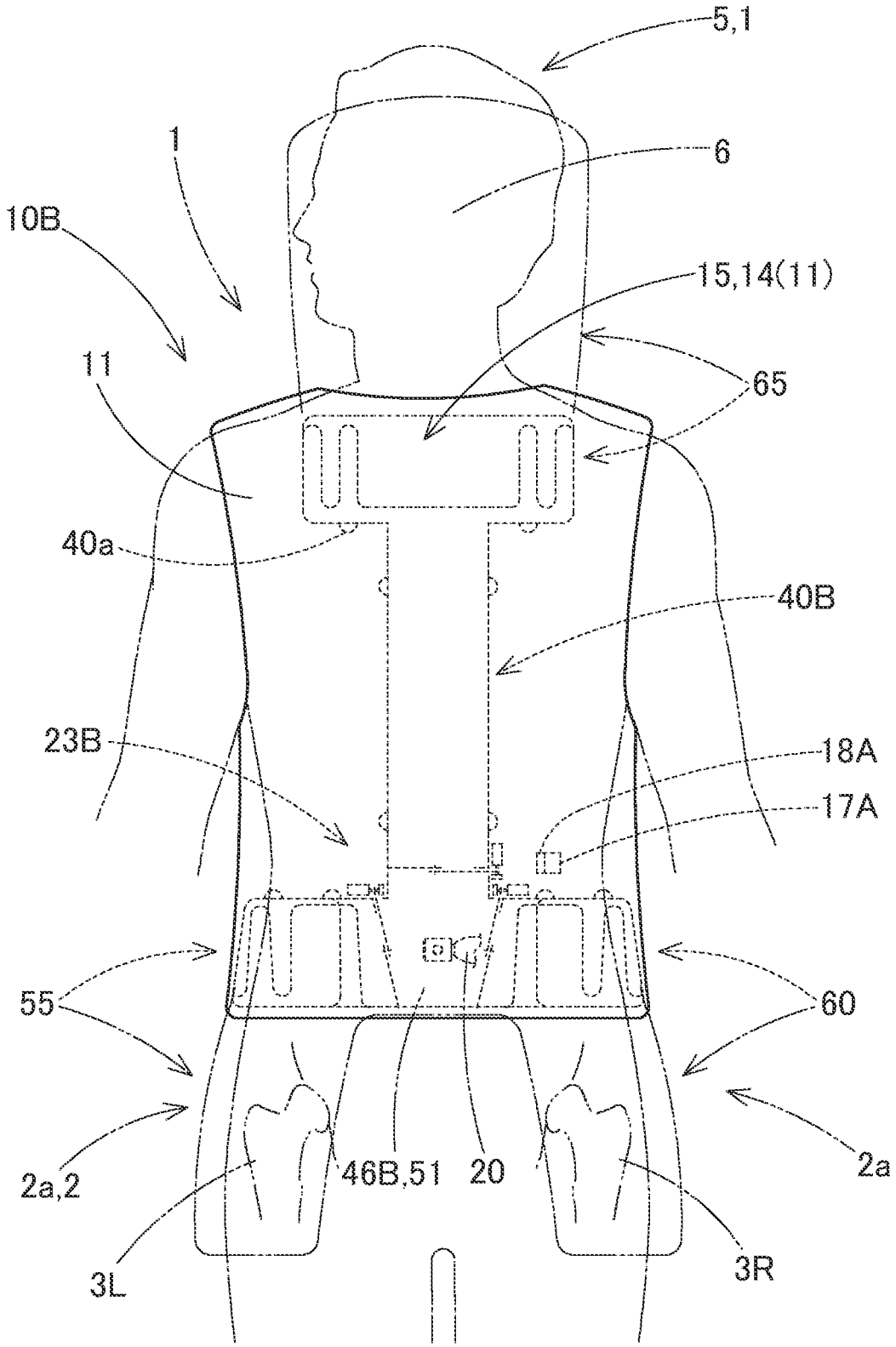
FIG. 11 is a back view of a wearable airbag device in accordance with the third exemplary embodiment as worn by the wearer.

If the wearer 1 wearing the wearable airbag device 10A described above falls toward the left, for example, the operation control device 17A receives a signal from the sensor part 18A having sensed that falling direction and actuates the gas generator 20 and actuator 32L of the gas switching mechanism 23A so that the inflation gas G from the gas generator 20 fills the branch chamber 46 and heightens the internal pressure of the branch chamber 46 while the actuator 32L withdraws the plunger 32*a*. Then the retained end 33*b* of the valve 33L is released from the plunger 32*a* and drawn into the branch chamber 46 via the through hole 49 due to pressure of the inflation gas G inside the branch chamber 46, and the valve 33L is further pushed into the inflatable portion 55, so that the opening 48L or inlet port 56 of the inflatable portion 55 opens, as can be seen in FIGS. 8A and 8B. As a consequence, the hip-protecting portion 58 of the inflatable portion 55 covers and protects the left trochanter 3L of femur (i.e. the targeted body part) of the wearer 1 disposed in the falling direction.

At this time, the inlet port 61 (or opening 48R) of the inflatable portion 60 does not open and stays closed by the valve 33R, since the actuator 32R is not actuated. Therefore, a small and light gas generator 20 will work since it does not have to inflate the inflatable portion 60.

If the wearer 1 falls toward the right to the contrary to the above, the operation control device 17A receives a signal from the sensor part 18A having sensed that falling direction and actuates the gas generator 20 and actuator 32R of the gas switching mechanism 23A so that the inflation gas G from the gas generator 20 fills the branch chamber 46 and heightens the internal pressure of the branch chamber 46 while the actuator 32R withdraws the plunger 32*a*. Then the retained end 33*b* of the valve 33R is released from the plunger 32*a* and drawn into the branch chamber 46 via the through hole 49 due to pressure of the inflation gas G inside the branch chamber 46, and the valve 33R is further pushed into the inflatable portion 60, so that the opening 48R or inlet port 61 of the inflatable portion 60 opens. As a consequence, the hip-protecting portion 63 of the inflatable portion 60 covers and protects the right trochanter 3R of femur (i.e. the targeted body part) of the wearer 1 disposed in the falling direction.

A wearable airbag device 10B in accordance with the third exemplary embodiment is now described referring to FIGS. 11 to 13C. An airbag 40B of the wearable airbag device 10B includes, as one of a plurality of inflatable portions, an inflatable portion 65 that includes a head-protecting portion 68 for covering the head 5, especially the back 6 of the head 5, of the wearer 1 as the targeted body part. Other than the head-protecting portion 68, the airbag 40B includes two inflatable portions 55, 60 each of which is provided with a hip-protecting portion 58/63 for covering the left/right side 2*a* of the hip 2 of the wearer 1, similarly to the airbags 40 and 40A in the first and second exemplary embodiments.

The head-protecting portion 68 in a standby state is stored in the neck portion 15 of the holding body 11 which is located at an upper portion of the back portion 14.

Figure 12:
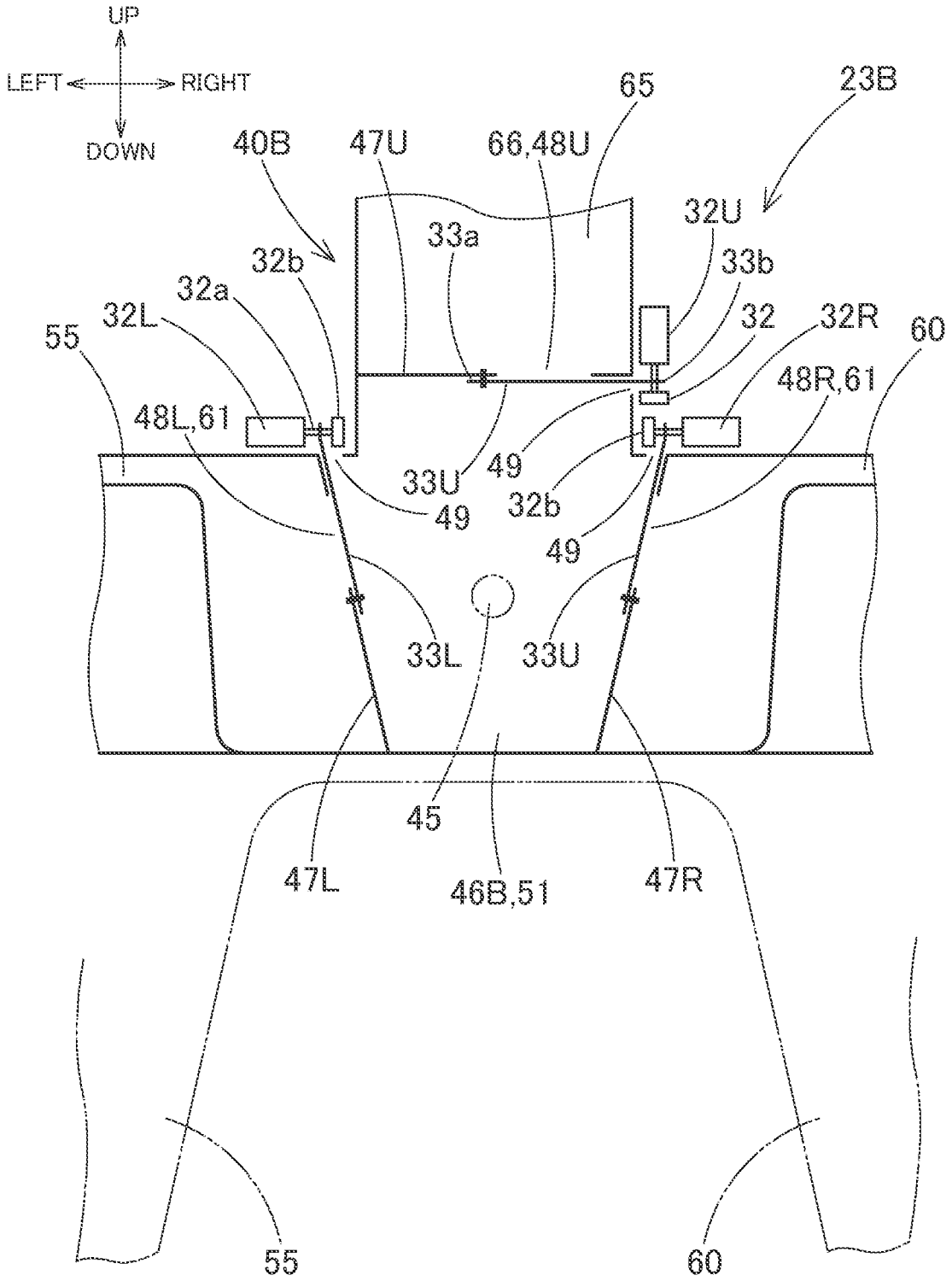
FIG. 12 is a diagram illustrating a gas switching mechanism of the third exemplary embodiment.

The airbag 40B includes, between the left and right inflatable portions 55, 60, a branch chamber 46B that acts as a connecting portion 51 for the inflatable portions 55, 60 and 65. The branch chamber 46B is partitioned from all of the inflatable portions 55, 60 and 65 by a partitioning wall 47L, a partitioning wall 47R, and a partitioning wall 47U, respectively. Each of the partitioning walls 47L and 47R has a same structure as those in the second exemplary embodiment. The partitioning wall 47U is provided with a round opening 48U that serves as an inlet port 66 of the inflatable portion 65. The opening 48U is normally closed by a valve 33U that is configured to be pushed into the inflatable portion 65 and open the opening 48U at actuation of an actuator 32U (FIG. 12). Similarly to other valves 33L, 33R, the left end of the valve 33U acts as a fixed end 33*a* that is fixed to a vicinity of the left edge of the opening 48U in the partitioning wall 47U on a side of the partitioning wall 47U facing the branch chamber 46B by sewing or the like. The right end of the valve 33U acts as a retained end 33*b* that is taken out of the airbag 40B via a through hole 49 formed in a right portion of the airbag 40B (or branch chamber 46B) and is retained by a plunger 32*a* of the actuator 32U composed of an electromagnetic solenoid or the like.

The branch chamber 46B of the airbag 40B is provided with an inlet port 45 that is connected with the gas generator 20, similarly to the second exemplary embodiment.

The gas switching mechanism 23B of the third exemplary embodiment includes three actuators 32 (32L, 32R, 32U), the branch chamber 46B that adjoins the inflatable portions 55, 60 and 65, three partitioning walls 47 (47L, 47R, 47U) each of which partitions the inflatable portion 55/60/65 from the branch chamber 46B, three openings 48 (48L, 48R, 48U) each of which is formed in the partitioning wall 47L/47R/47U and acts as an inlet port 56/61/66 of the inflatable portion 55/60/65, and three valves 33 (33L, 33R, 33U) each of which closes the opening 48 (48L/48R/48U) and is configured to open the opening 48 (48L/48R/48U) by operation of the actuator 32 (32L/32R/32U).

Figure 13A:
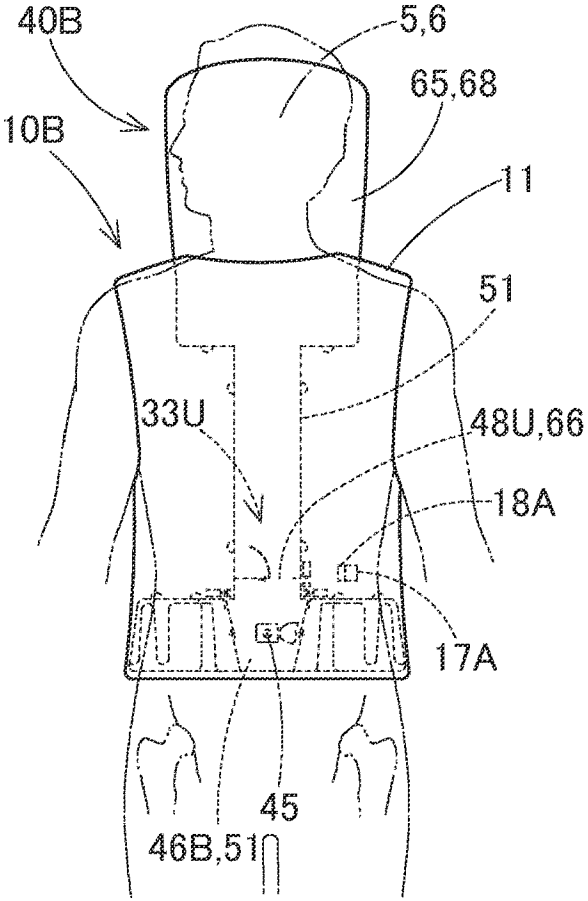
FIG. 13A illustrates the first mode of operation of the wearable airbag device in accordance with the third exemplary embodiment.

If the wearer 1 wearing the wearable airbag device 10B described above falls backward, for example, the operation control device 17A receives a signal from the sensor part 18A having sensed that falling direction and actuates the gas generator 20 and actuator 32U so that the inflation gas G from the gas generator 20 fills the branch chamber 46B and heightens the internal pressure of the branch chamber 46B while the actuator 32U withdraws the plunger 32*a*. Then the retained end 33*b* of the valve 33U is released from the plunger 32*a* and drawn into the branch chamber 46B via the through hole 49 due to pressure of the inflation gas G inside the branch chamber 46B, and the valve 33U is further pushed into the inflatable portion 65, so that the opening 48U or inlet port 66 of the inflatable portion 65 opens, as can be seen in FIGS. 12 and 13A. As a consequence, the head-protecting portion 68 of the inflatable portion 65 covers and protects the back 6 of the head 5 (i.e. the targeted body part) of the wearer 1 disposed in the falling direction.

At this time, the inlet ports 56, 61 (or openings 48L, 48R) of the inflatable portions 55, 60 do not open and stay closed by the valves 33L, 33R, since the actuators 32L, 32R are not actuated. Therefore, a small and light gas generator 20 will work since it does not have to inflate the inflatable portions 55, 60.

Figure 13B:
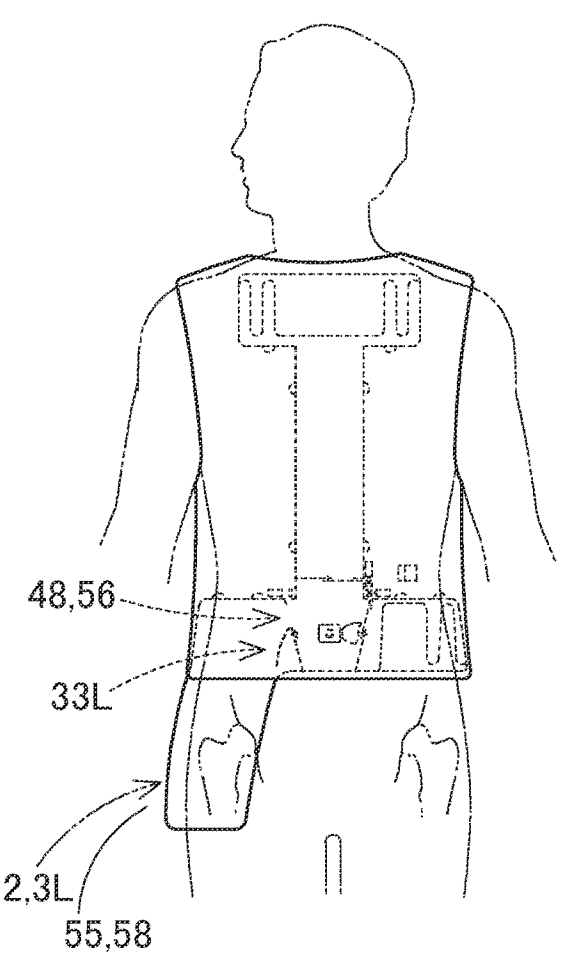
FIG. 13B illustrates the second mode of operation of the wearable airbag device in accordance with the third exemplary embodiment.
Figure 13C:
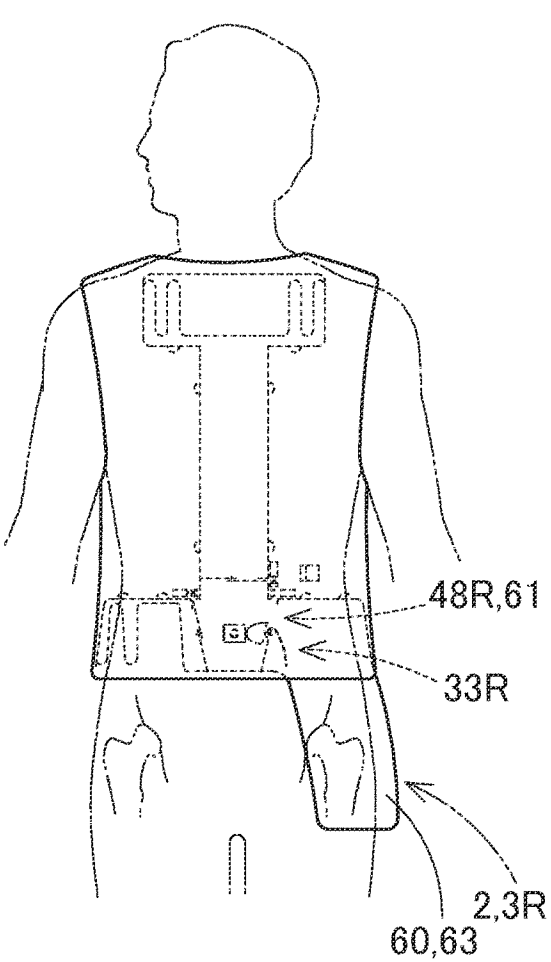
FIG. 13C illustrates the third mode of operation of the wearable airbag device in accordance with the third exemplary embodiment.

If the wearer 1 falls toward the left or toward the right, the operation control device 17A detects that falling direction and actuates the gas generator 20 and actuator 32L or 32R so as to inflate the inflatable portion 55 only or inflatable portion 60 only, as can be seen in FIGS. 13B and 13C.

Figure 14A:
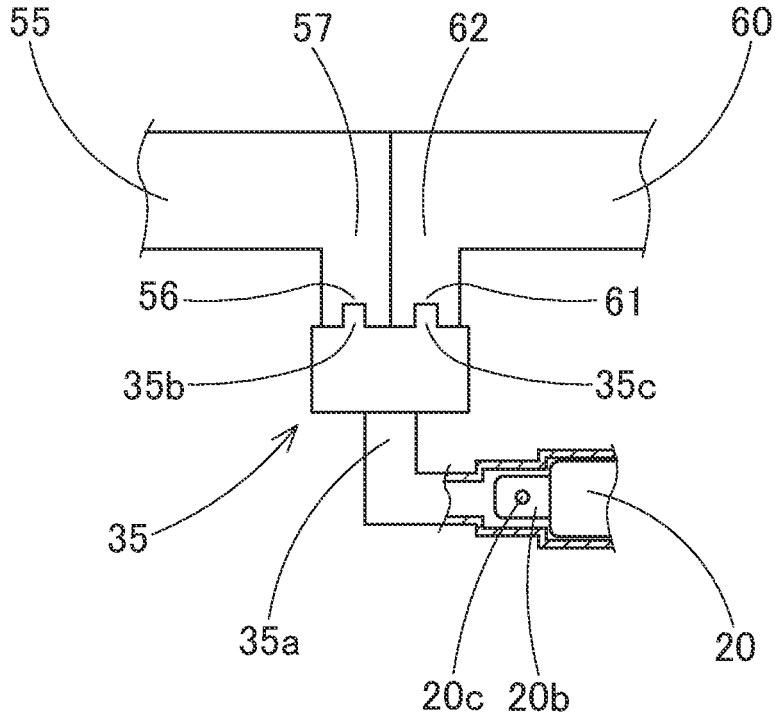
FIG. 14A illustrates a modification of the gas switching mechanism of the second exemplary embodiment.
Figure 14B:
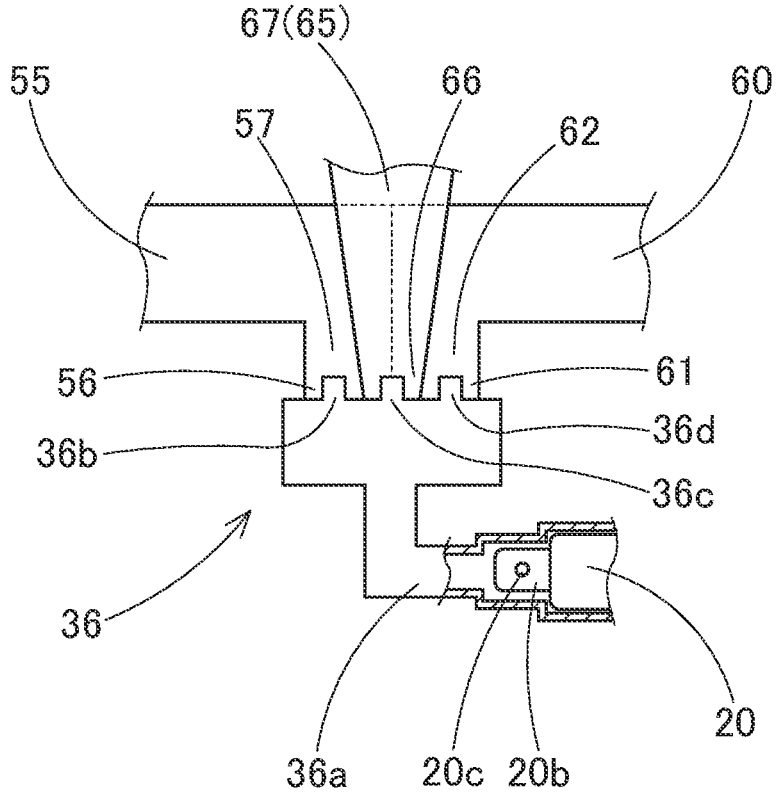
FIG. 14B illustrates a modification of the gas switching mechanism of the third exemplary embodiment.
Figure 15:
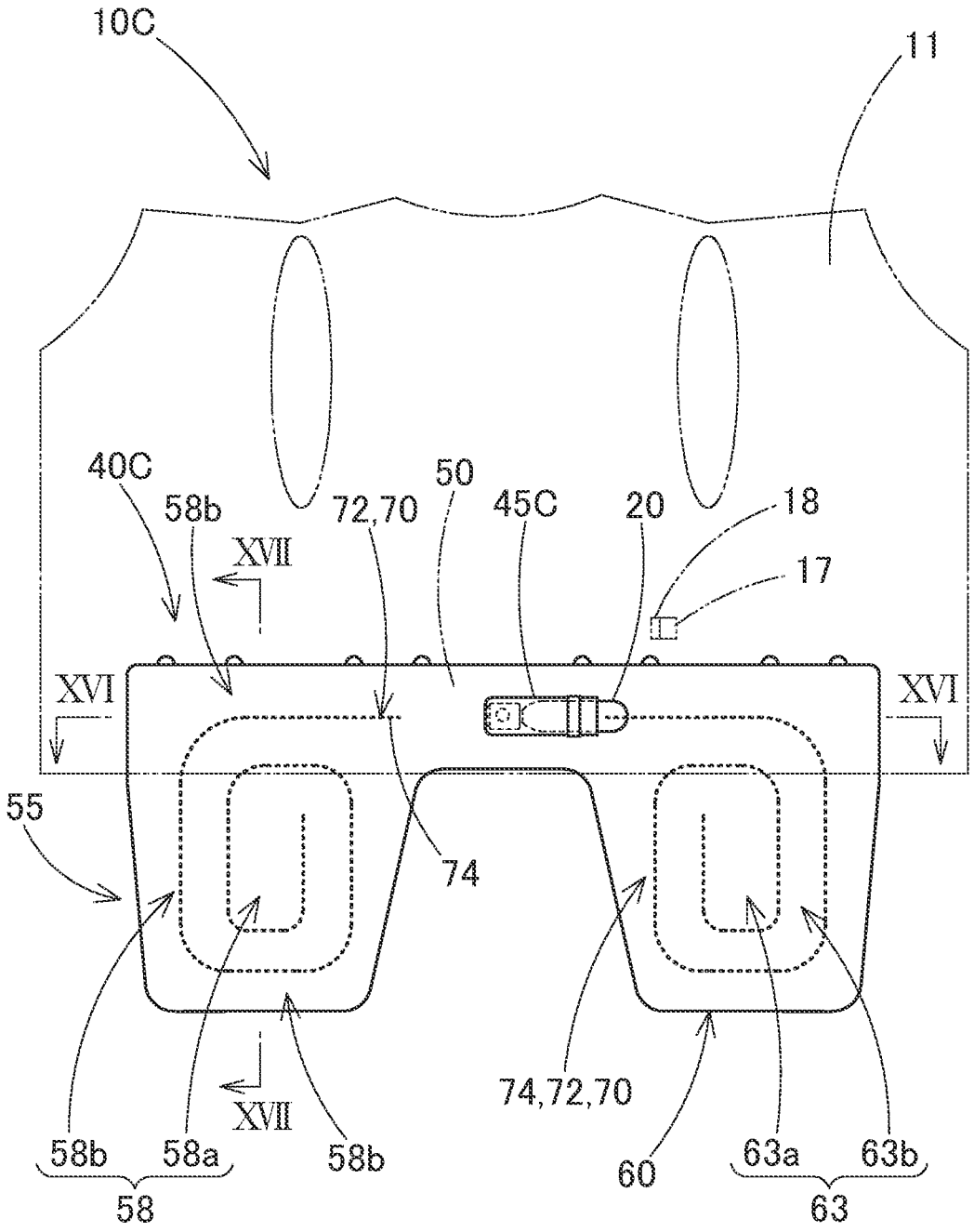
FIG. 15 is a schematic back view of a wearable airbag device in accordance with the fourth exemplary embodiment.
Figure 16:
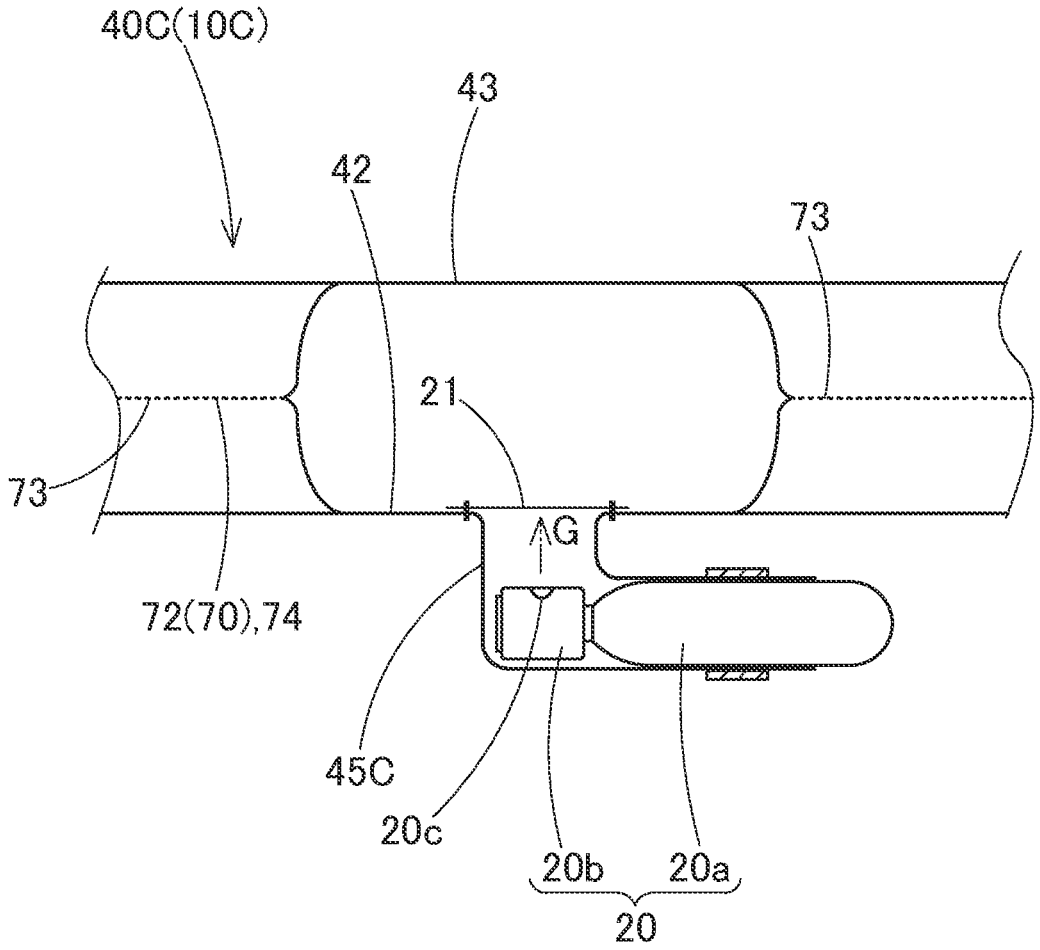
FIG. 16 is a schematic cross-sectional view taken along line XVI-XVI of FIG. 15.

In the wearable airbag devices 10A, 10B in accordance with the second and third exemplary embodiments, each of the gas switching mechanisms 23A, 23B employs the actuators 32 (32L, 32R, 32U) in order to make the valves 33 (33L, 33R, 33U) open the openings 48 (48L, 48R, 48U) (i.e. inlet ports 56, 61, 66). Alternatively, the gas switching mechanism may employ a changeover valve 35/36 that is able to change the destination of the inflation gas G emitted from the gas generator 20 over to the inflatable portion 55, 60 or 65, as can be seen in FIGS. 14A and 14B. The changeover valve 35/36 is configured to open either one of the inlet ports 56, 61, 66 of the inflatable portion 55, 60 or 65 by withdrawing a not-shown plunger composed of an electromagnetic solenoid. The changeover valve 35/36 includes a gas entrance section 35*a*/36*a* that is in gas communication with the gas generator 20 and two or three gas exit sections 35*b* and 35*c*/36*b*, 36*c* and 36*d* each of which is connected with gas introductory portion 57, 62, 67 of the inflatable portion 55/60/65.

A wearable airbag device 100 in accordance with the fourth exemplary embodiment is now described referring to FIGS. 15 to 18B.

The wearable airbag device 10C is formed by mounting a gas generator 20, an airbag 40C, and an operation control device 17 provided with a sensor part 18 on a holding body 11, in a similar fashion to the first and second exemplary embodiments.

The airbag 40C includes two, left and right inflatable portions 55, 60 and a connecting portion 50 that is disposed between the inflatable portions 55, 60 in gas communication with both of the inflatable portions 55, 60. The connecting portion 50 has a reduced width compared to the inflatable portions 55, 60. The connecting portion 50 is provided with a tubular gas inlet section 45C that is connected with a gas discharge portion 20*b* of the gas generator 20. The gas inlet section 45C is provided with a filtering member 21 for capturing gas residue.

Each of the left and right inflatable portions 55, 60 includes a thickness-regulating means 70 that limits the thickness of the inflatable portion 55/60 as inflated. The thickness-regulating means 70 of the airbag 40C is composed of a jointing element 72 that joins opposing portions of an outer shell 41 of the airbag 40C together in a state where the opposing portions are brought close to one another.

Figure 17:
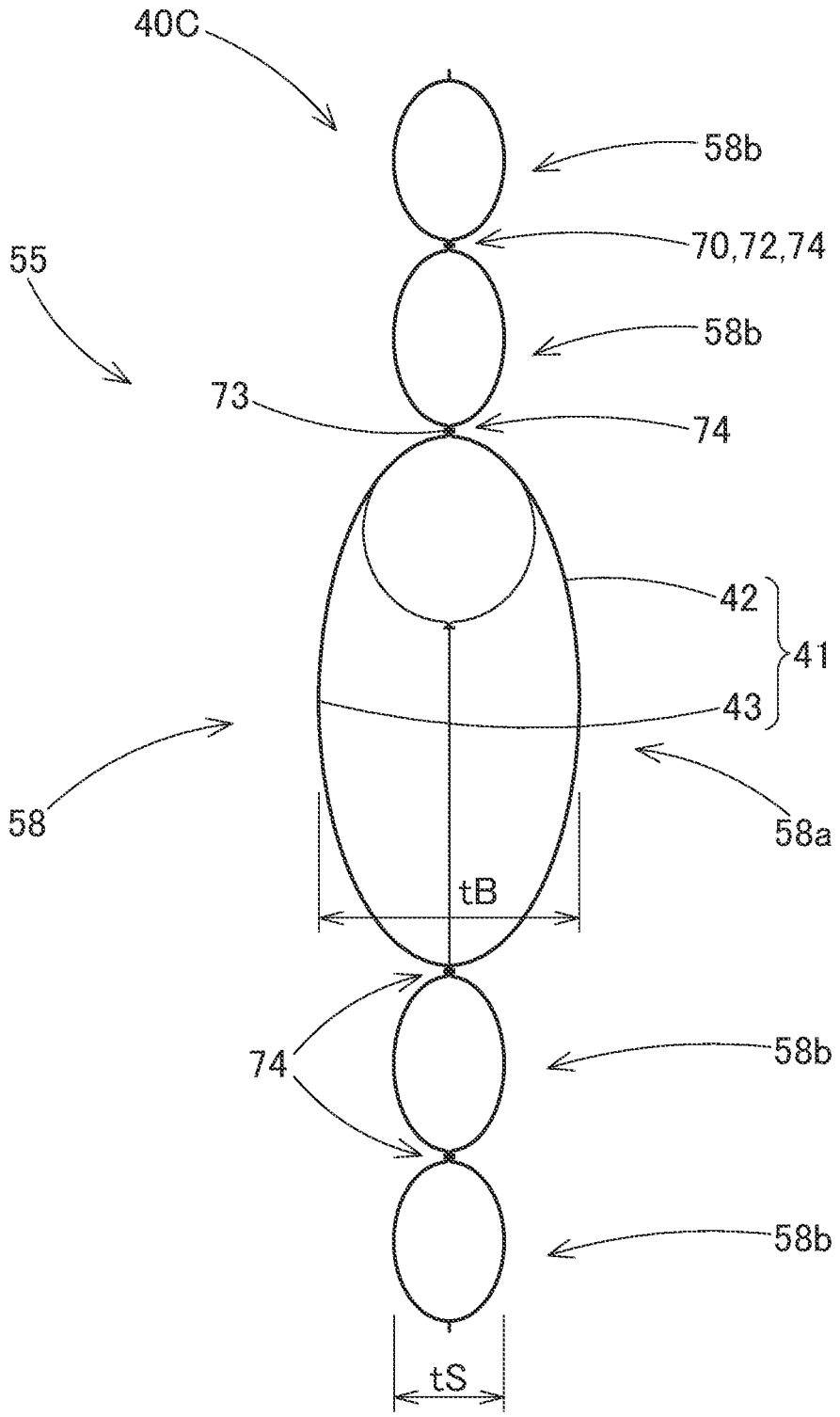
FIG. 17 is a schematic cross-sectional view taken along line XVII-XVII of FIG. 15.

More particularly, the outer shell 41 of the airbag 40 includes an outer wall 42 that is configured to face away from the wearer 1 at airbag deployment, and an inner wall 43 that is configured to face the wearer 1 at airbag deployment. The jointing element 72 of the airbag 40C is composed of a seam 74 that connects (sews) the outer wall 42 and the inner wall 43 together partially and directly by sewing with sewing threads 73, as can be seen in FIG. 17. The seam 74 is formed into a spiral form that extends from a vicinity of the connecting portion 50 in each of the inflatable portions 55, 60. The seams 74 help inflate the inflatable portions 55, 60 each in a rectangular board shape having a substantially uniform thickness.

Figure 18B:
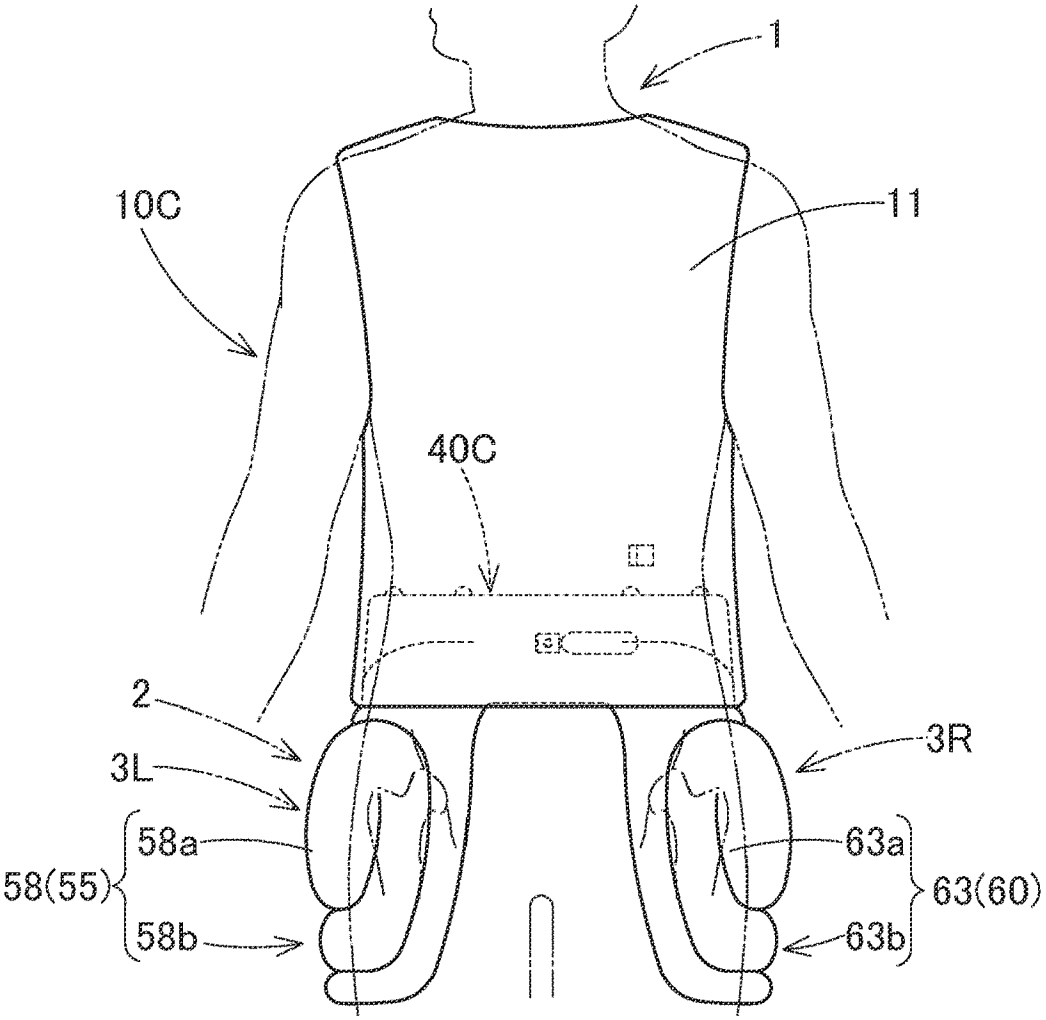
FIG. 18B is a schematic back view of the wearable airbag device in accordance with the fourth exemplary embodiment as actuated.
Figure 18A:
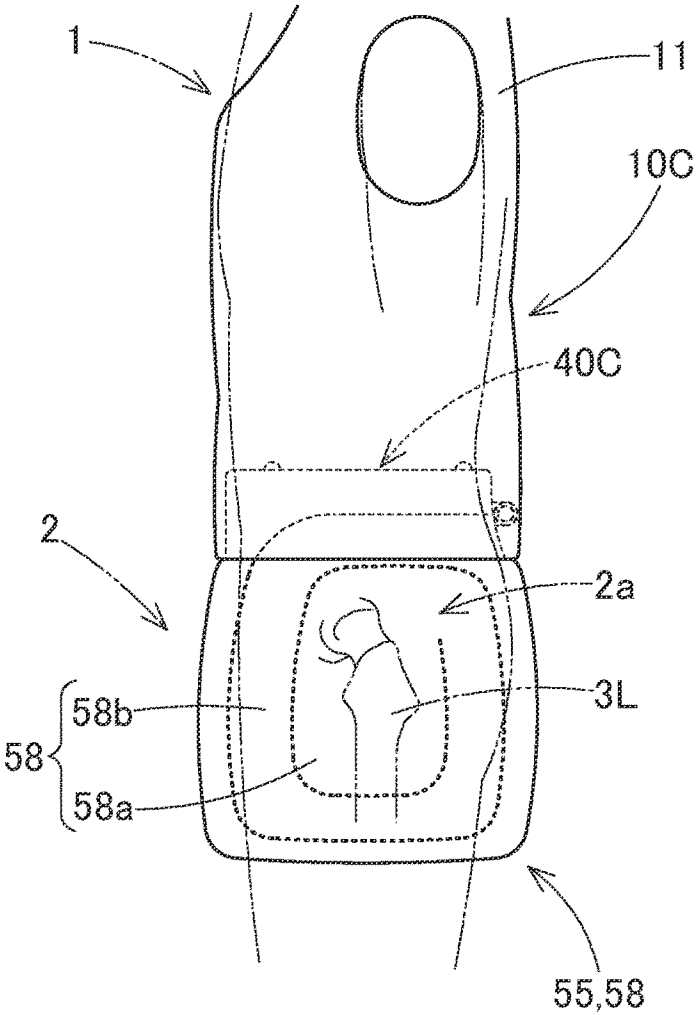
FIG. 18A is a schematic side view of the wearable airbag device in accordance with the fourth exemplary embodiment as actuated.

Moreover, in the airbag 40C, each of the inflatable portions 55, 60 includes the left/right hip-protecting portion 58/63 that is adapted to cover the left/right trochanter of femur and its surroundings in the hip 2 of the wearer 1 as the targeted body part, and each of the hip-protecting portions 58, 63 is configured such that a portion (namely, a main protecting portion) 58*a*/63*a* that is adapted to be deployed over the trochanter 3L/3R of femur has a greater thickness than a portion 58*b*/63*b* adjoining thereto (namely, a peripheral portion) when inflated, as can be seen in FIGS. 17, 18A and 18B.

That is, at airbag deployment, the seam 74 makes each of the hip-protecting portions 58, 63 substantially uniformly thick, but inside the hip-protecting portion 58*a*/63*a*, the seam 74 produces a slight difference in thickness from the main protecting portion 58*a*/63*a* for covering the trochanter 3L/3R of femur to the peripheral portion 58*b*/63*b* adjoining thereto. That is, the thickness tB of the main protecting portions 58*a*, 63*a* is greater than the thickness tS of the peripheral portions 58*b*, 63*b* (i.e. tB>tS) in order to attain a sufficient protection of the trochanters 3L, 3R of femur.

If the wearer 1 wearing the wearable airbag device 10C in accordance with the fourth exemplary embodiment falls, the operation control device 17 actuates the gas generator 20 to inflate the airbag 40C in response to a signal from the sensor part 18 having sensed the fall. In the airbag 40C as inflated, each of the inflatable portions 55, 60 is not inflated spherically, but inflated into a board shape (in a rectangular board shape, in this specific embodiment) due to the presence of the seam 74 (i.e. the thickness-regulating means 70). Therefore, each of the inflatable portions 55/60 is able to cover the respective targeted body part 3L/3R widely and adequately. Since each of the inflatable portions 55, 60 is configured to be inflated into a board shape having a limited volume, the gas generator 20 for inflating the airbag 40C does not need to have a high output.

Therefore, the wearable airbag device 100 in accordance with the fourth exemplary embodiment only needs a small and light gas generator to inflate the airbag 40C.

In the fourth exemplary embodiment, moreover, the inflatable portions 55, 60 respectively includes the hip-protecting portion 58 and the hip-protecting portion 63 each of which is adapted to cover the left side/right side of the hip 2 (i.e. the targeted body part) of the wearer 1, and each of the hip-protecting portions 58, 63 is configured such that the main protecting portion 58*a*/63*a* that is adapted to be deployed over the trochanter 3L/3R of femur is greater in thickness than the peripheral portion 58*b*/63*b* adjoining thereto when inflated (i.e. tB>tS).

The airbag 40C with the above configuration will be able to adequately cover the left and right trochanters 3L, 3R of femur, which would require special protection, with the main protecting portions 58*a*, 63*a*, as can be seen in FIGS. 18A and 18B. It is important to protect the trochanters 3L, 3R of femur because a damage to the trochanter tends to lead to fracture of the thigh bone which would take a long time to treat.

Figure 19:
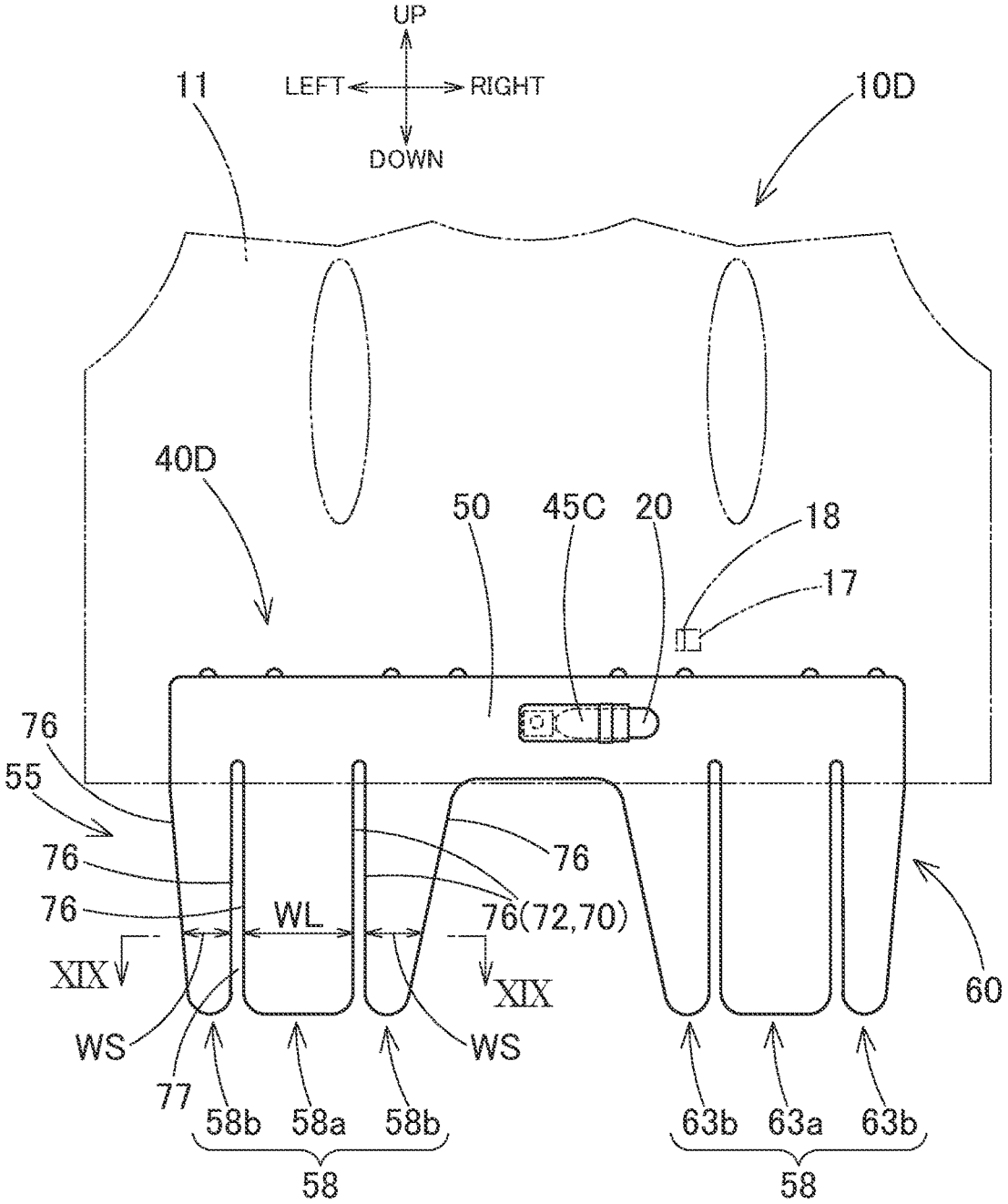
FIG. 19 is a schematic back view of a wearable airbag device in accordance with the fifth exemplary embodiment.
Figure 19:
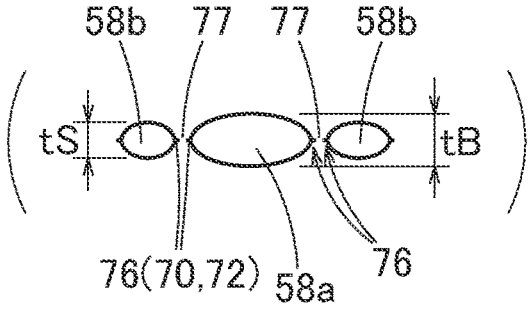
Figure 20B:
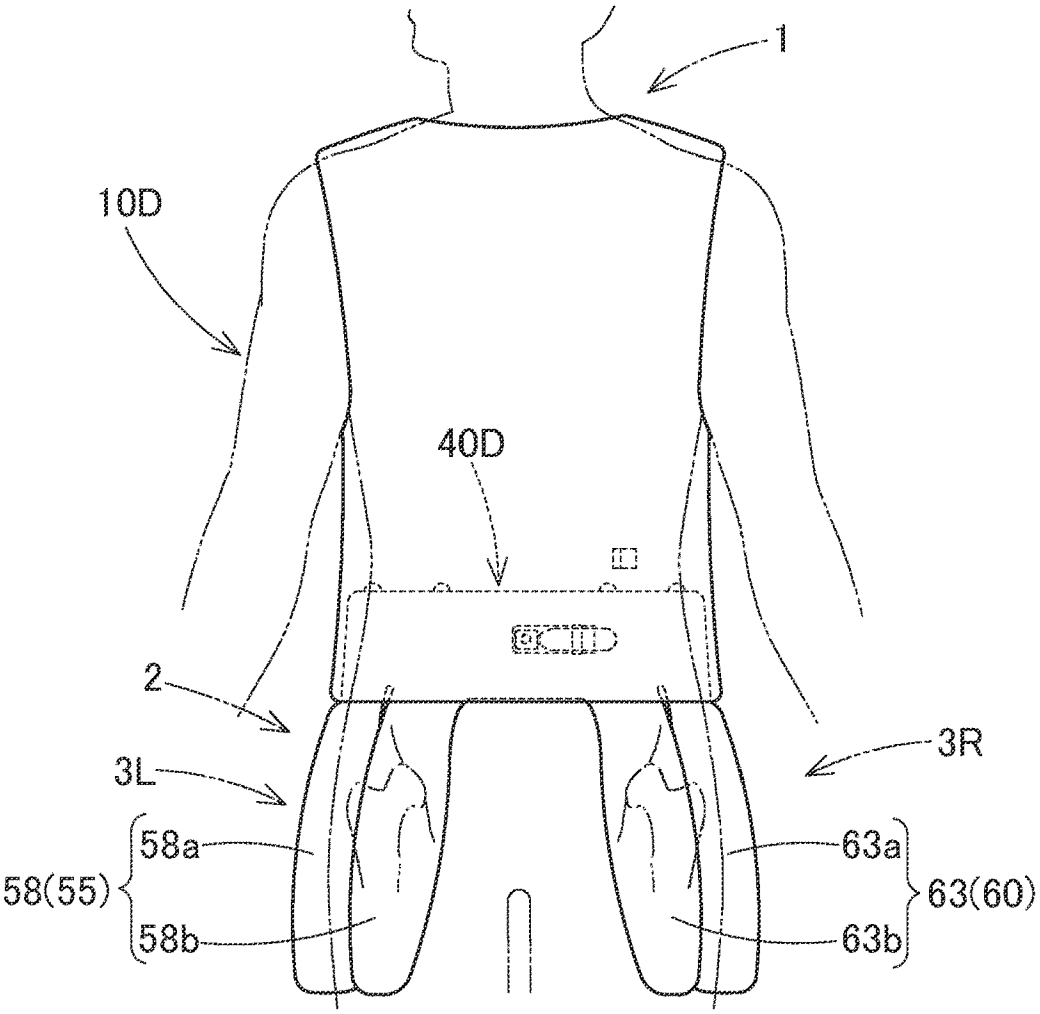
FIG. 20B is a schematic back view of the wearable airbag device in accordance with the fifth exemplary embodiment as actuated.

The jointing element as the thickness-regulating means 70 that joints opposing portions of the outer shell of the airbag together in a state where the opposing portions are brought close to one another may be configured like the one in a wearable airbag device 10D in accordance with the fifth exemplary embodiment depicted in FIGS. 19 to 20B. An airbag 40D of the wearable airbag device 10D includes, in each of the inflatable portions 55, 60, a closing portion 76 that joints opposing portions of an outer shell of the airbag 40D together at the outer circumferential edge of the inflatable portion 55/60. The closing portion 76 define an outer shape of each of the inflatable portions 55, 60 in a direction perpendicular to the thickness direction of the inflatable portion 55/60. These closing portions 76 will also contribute to inflating the inflatable portions 55, 60 effectively for covering the targeted body parts 3L, 3R while suppressing the volume of each of the inflatable portions 55, 60.

Figure 20A:
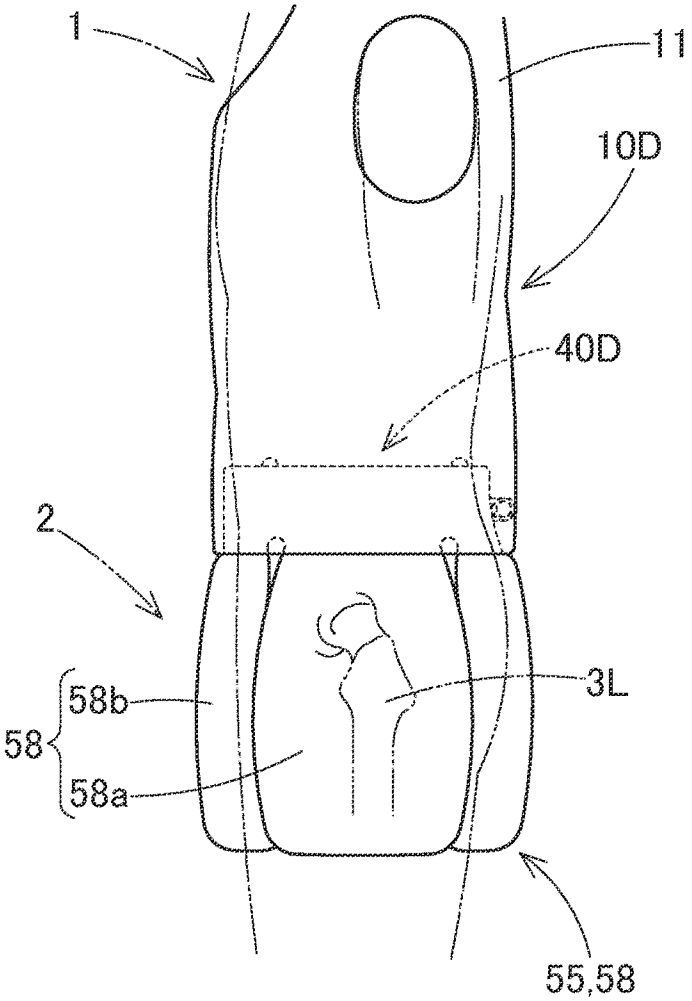
FIG. 20A is a schematic side view of the wearable airbag device in accordance with the fifth exemplary embodiment as actuated.

The wearable airbag device 10D in accordance with the fifth exemplary embodiment is identical to the fourth exemplary embodiment in configurations in the gas generator 20, operation control device 17, and the holding body 11 that holds them, but differs from the fourth exemplary embodiment in configuration of the airbag 40D. The airbag 40D includes two inflatable portions 55, 60 for protecting the left and right sides of the hip 2, and a connecting portion 50 between the inflatable portions 55, 60. In each of the inflatable portions 55, 60, however, a main protecting portion 58*a*/63*a* adapted to cover the trochanter 3L/3R of femur is located in a central portion in a left and right direction of the inflatable portion 55/60, and two each peripheral portions 58*b*/63*b* are located on both sides of the main protecting portion 58*a*/63*a*. As can be seen in FIG. 19, the width WL of each of the main protecting portions 58*a*/63*a* (in other words, the width WL between the closing portions 76 located in the left and right edges of the main inflatable portion 58*a*/63*a*) is greater than the width WS of each of the peripheral portions 58*b*/63*b* (in other words, the width WS between the closing portions 76 located in the left and right edges of the peripheral portion 58*b*/63*b*), so that the thickness tB of each of the main protecting portions 58*a*, 63*a* as inflated is greater than the thickness tS of each of the peripheral portions 58*b*, 63*b* as inflated. This way, each of the inflatable portions 55, 60 is able to cover the targeted body part 3L/3R effectively while being suppressed in volume, as can be seen in FIGS. 20A and 20B.

This airbag 40D includes slits 77 between the closing portions 76 of the main protecting portion 58*a*/63*a* and the closing portions 76 of the peripheral portions 58*b*/63*b* on both sides of the main protecting portion 58*a*/63*a*, as can be seen in FIG. 19. However, the airbag may be formed with such extended closing portions 76 that would fill the slits 77. With the configuration that the slits 77 are formed, the free spaces composed of the slits 77 will enable the main protecting portion 58*a*/63*a* and the peripheral portions 58*b*/63*b* to be deployed in proximity to one another and surround the hip 2 of the wearer in a semi-arc shape, i.e. in proximity to the hip 2.

The jointing element as the thickness-regulating means may also be composed of a tether that connects opposing portions of an outer shell of the airbag indirectly, as in an airbag 40E of the sixth exemplary embodiment depicted in FIGS. 21A to 22B.

Figure 21B:
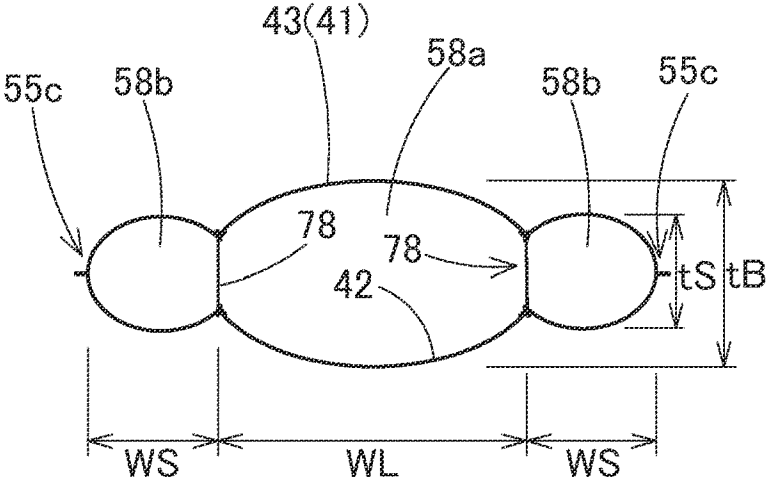
FIG. 21B is a schematic sectional end view taken along line XXI-XXI of FIG. 21A.
Figure 21A:
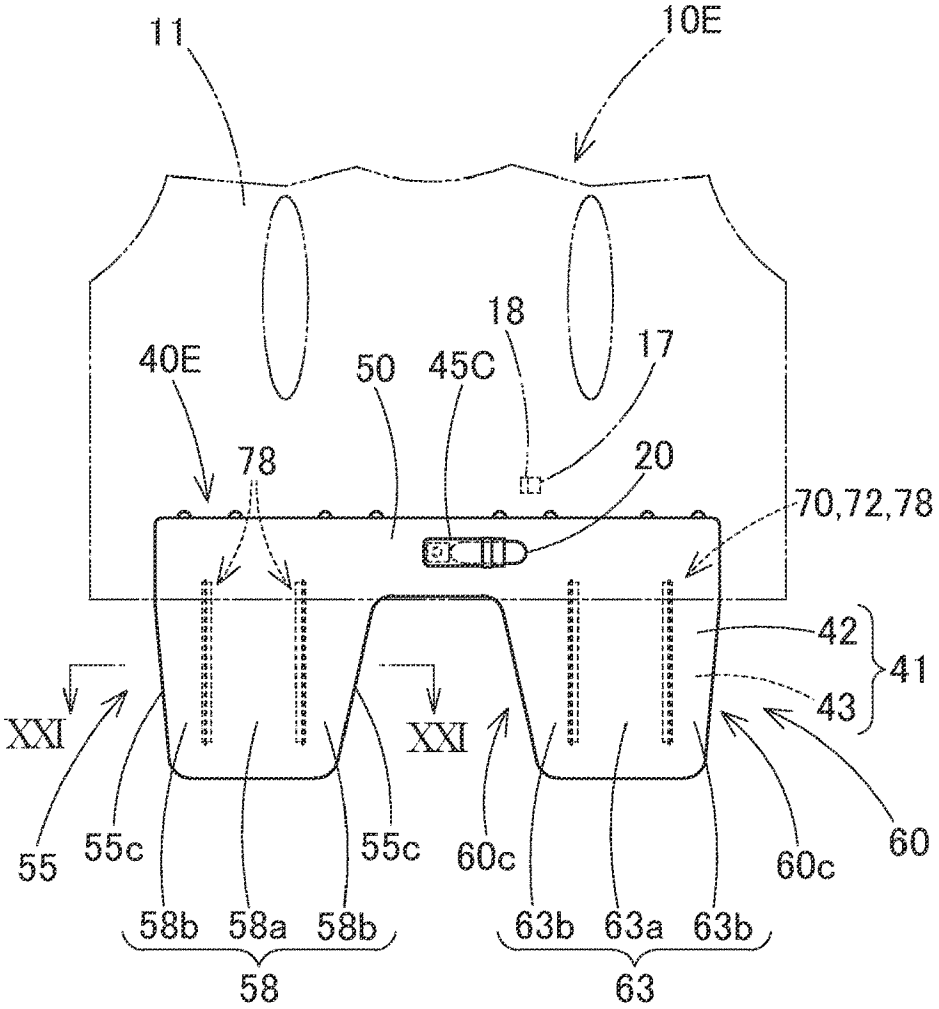
FIG. 21A is a schematic back view of a wearable airbag device in accordance with the sixth exemplary embodiment.
Figure 22B:
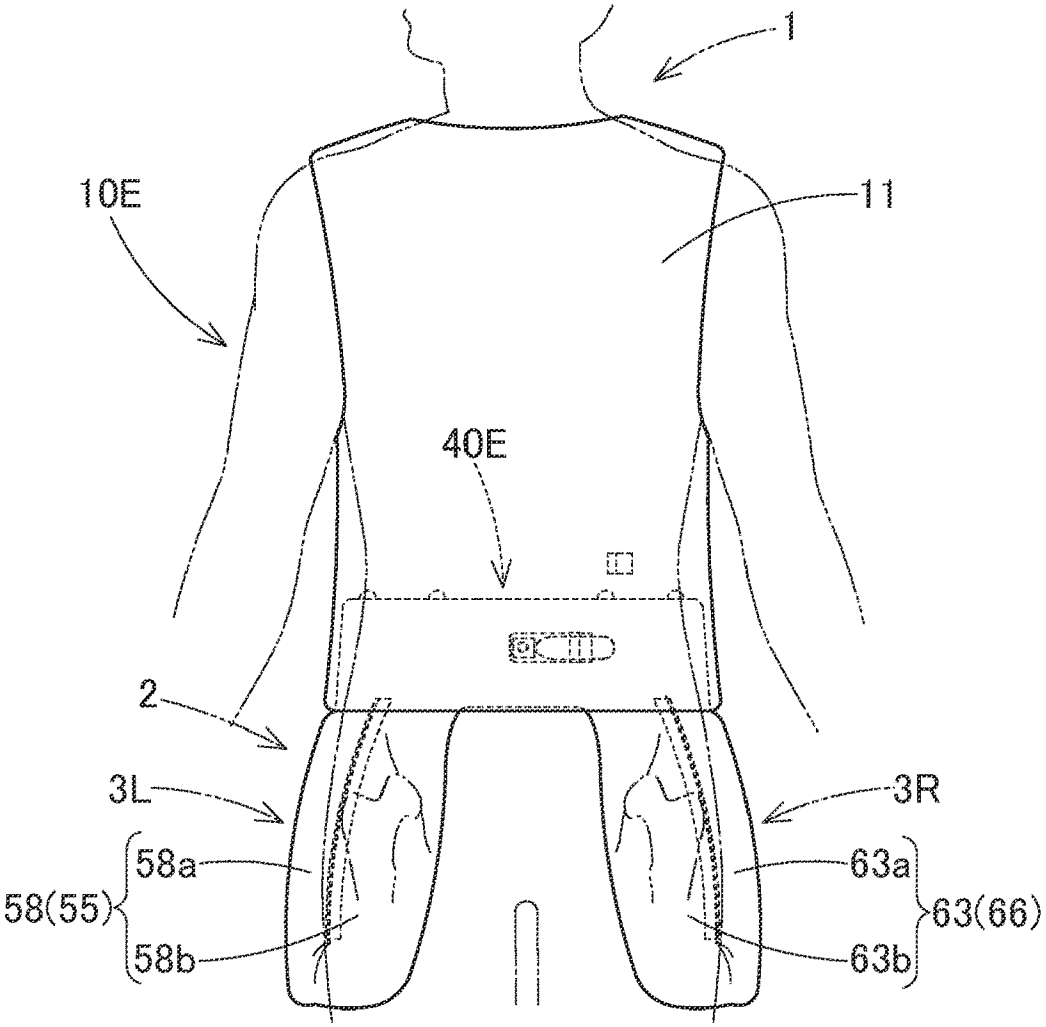
FIG. 22B is a schematic back view of the wearable airbag device in accordance with the sixth exemplary embodiment as actuated.
Figure 22A:
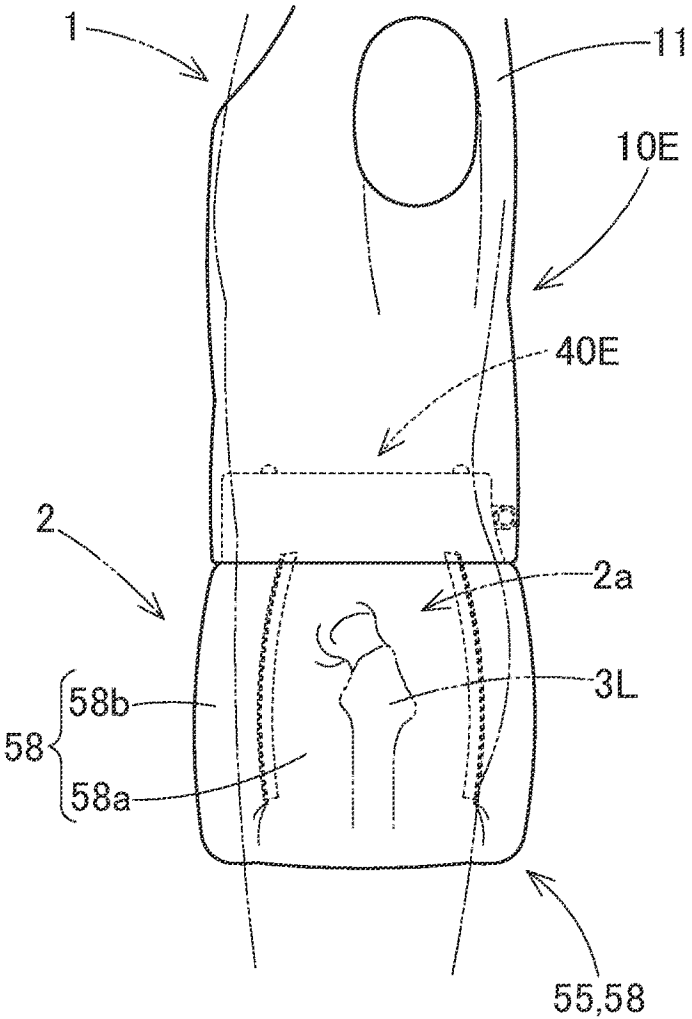
FIG. 22A is a schematic side view of the wearable airbag device in accordance with the sixth exemplary embodiment as actuated.

The airbag 40E in accordance with the sixth exemplary embodiment includes, in each of the hip-protecting portions 58, 63 of the inflatable portions 55, 60, two tethers 78 each of which is formed into a band extending in an up and down direction and connects the outer wall 42 and inner wall 43 of the outer shell 41 together. In each of the hip-protecting portions 58, 63, the two tethers 78 define a main protecting portion 58*a*/63*a* for covering the trochanter 3L/3R of femur and surroundings there between. As can be seen in FIG. 21B, the width WL of each of the main protecting portions 58*a*, 63*a* (i.e. the distance WL between the two tethers 78) is greater than the width WS of each of the peripheral portions 58*b*, 63*b* (i.e. the distance WS from each of the tethers 78 to the edge 55*c*/60*c* of the inflatable portion 55/60), so that the thickness tB of each of the main protecting portions 58*a*, 63*a* as inflated is greater than the thickness tS of each of the peripheral portions 58*b*, 63*b* as inflated.

If the wearer 1 wearing the wearable airbag device 10E in accordance with the sixth exemplary embodiment falls, the operation control device 17 actuates the gas generator 20 to inflate the airbag 40E in response to a signal from the sensor part 18 having sensed the fall. In the airbag 40E as inflated, each of the inflatable portions 55, 60 for covering the targeted body part 3L/3R is not inflated spherically, but inflated into a board shape (in a rectangular board shape, in this specific embodiment) due to the presence of the tethers 78 (i.e. the thickness-regulating means 70). Therefore, the airbag 40E is able to cover and protect the targeted body parts 3L, 3R widely and adequately with the inflatable portions 55, 60. Since the inflatable portions 55, 60 are configured to be inflated into a board shape having a limited thickness, the gas generator 20 for inflating the airbag 40E does not have to have a high output.

Also in the sixth exemplary embodiment, the inflatable portions 55, 60 respectively includes the hip-protecting portion 58 and the hip-protecting portion 63 each of which is adapted to cover the left side/right side of the hip 2 (i.e. the targeted body part) of the wearer 1, and each of the hip-protecting portions 58, 63 is configured such that the main protecting portion 58*a*/63*a* for protecting the trochanter 3L/3R of femur is greater in thickness than the peripheral portion 58*b*/63*b* adjoining thereto when inflated (i.e. tB>tS).

Therefore, the airbag 40E in accordance with the sixth exemplary embodiment will also be able to adequately cover the left and right trochanters 3L, 3R of femur, which would require special protection, with the main protecting portions 58*a*, 63*a*.

Figure 23B:
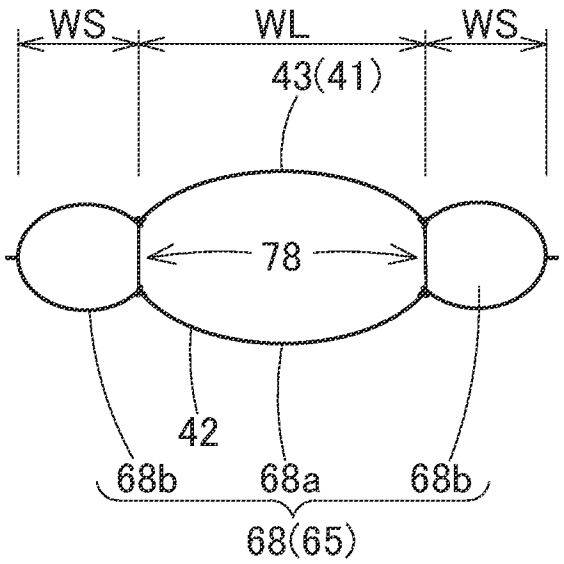
FIG. 23B is a schematic sectional end view taken along line XXIII-XXIII of FIG. 23A.
Figure 23A:
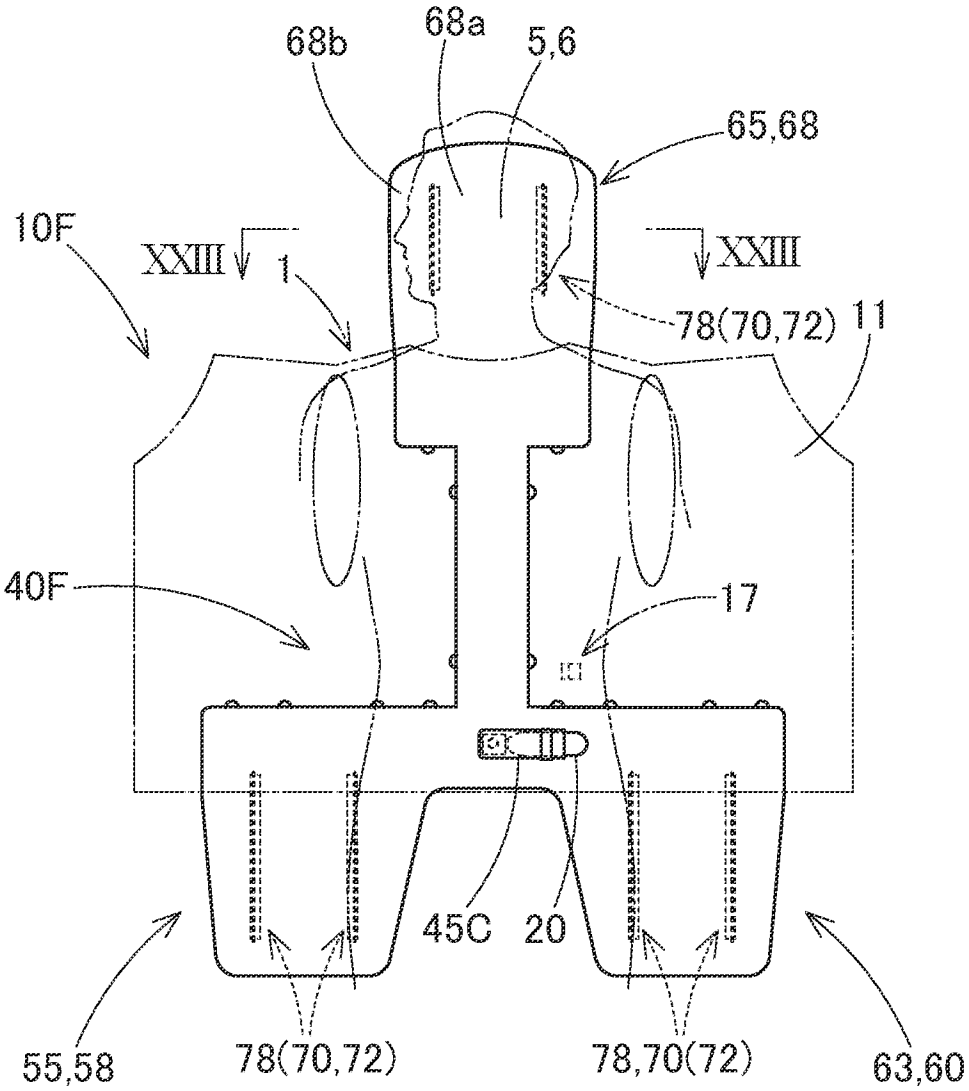
FIG. 23A is a schematic back view of a wearable airbag device in accordance with the seventh exemplary embodiment.

The thickness-regulating means may also be applied to an airbag that includes an inflatable portion 65 including a head-protecting portion 68 for covering the back 6 of the head 5 in addition to the left and right inflatable portions 55, 60, like in an airbag 40F of a wearable airbag device 10F in accordance with the seventh exemplary embodiment depicted in FIGS. 23A and 23B. The inflatable portion 65 is provided with two tethers 78 configured like those in the sixth exemplary embodiment so as to be inflated substantially into a board shape. The inflatable portion 65 includes a main protecting portion 68*a* between the tethers 78, and two peripheral portions 68*b* that are located to the edges of the inflatable portion 65 from the tethers 78 and each has a thickness slightly smaller than that of the main protecting portion 68*a*.

Figure 24A:
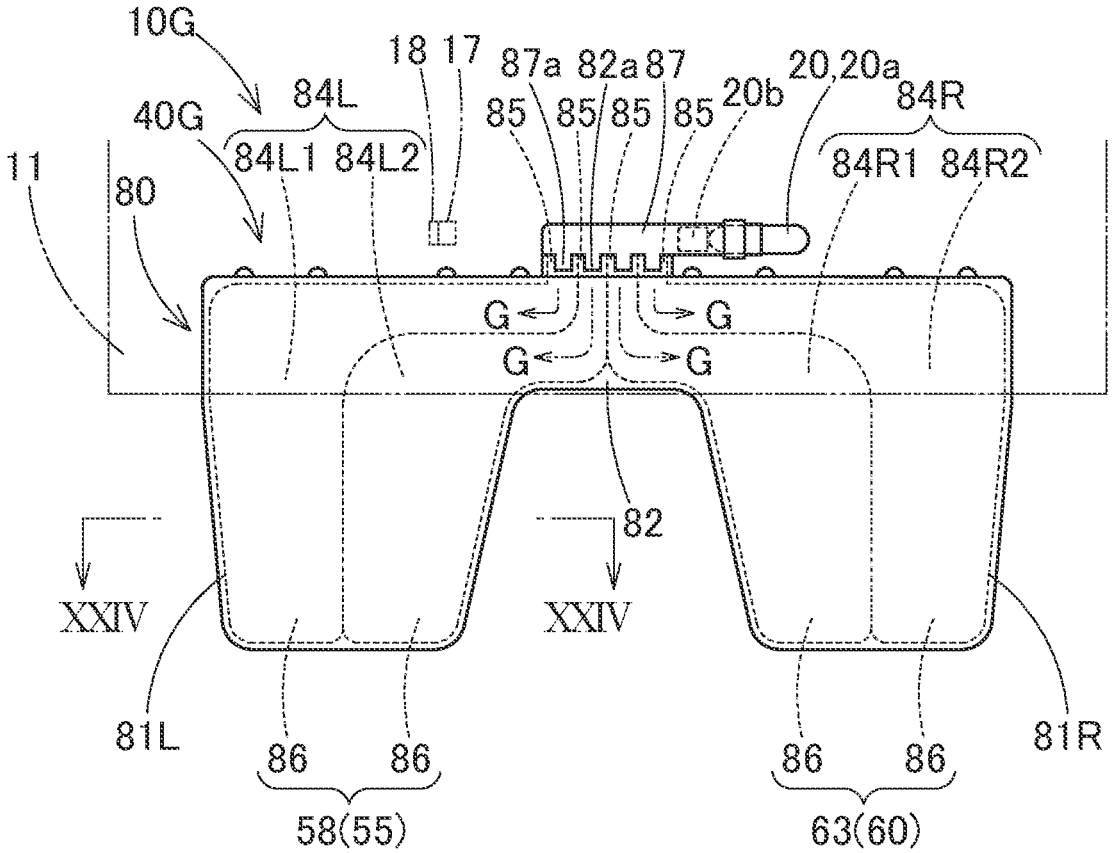
FIG. 24A is a schematic back view of a wearable airbag device in accordance with the eighth exemplary embodiment.
Figure 24B:
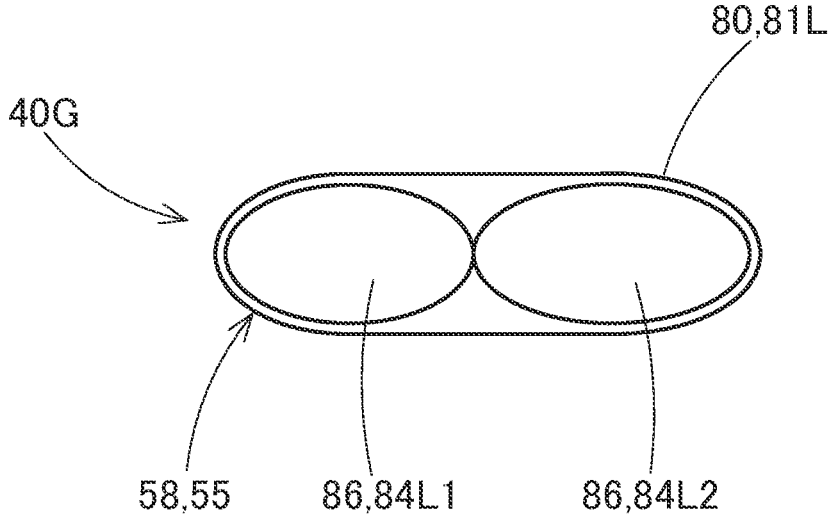
FIG. 24B is a schematic sectional end view taken along line XXIV-XXIV of FIG. 24A.
Figure 25:
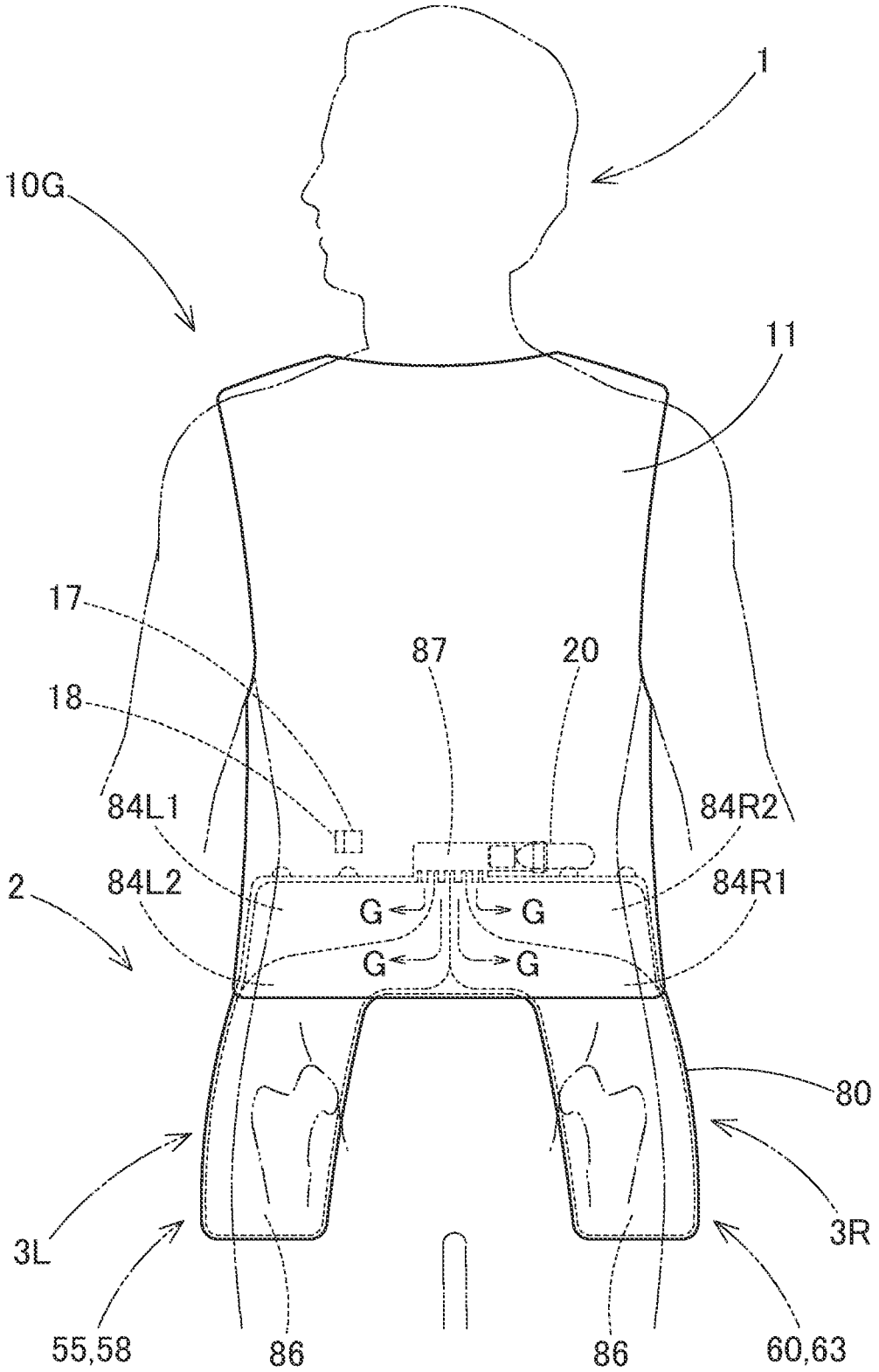
FIG. 25 is a schematic back view of the wearable airbag device in accordance with the eighth exemplary embodiment as actuated.

A wearable airbag device 10G in accordance with the eighth exemplary embodiment is now described referring to FIGS. 24A to 25.

The wearable airbag device 10G is formed by mounting a gas generator 20, an airbag 40G, and an operation control device 17 provided with a sensor part 18 on a holding body 11, in a similar fashion to the first and second exemplary embodiments.

The airbag 40G includes a plurality of inner bags 84L, 84R as the inflatable portions 55, 60 that are inflatable with an inflation gas G fed from the gas generator 20, and an outer bag 80 that covers the inflatable portions 55, 60 (i.e. the inner bags 84L, 84R). Each of the inflatable portions 55, 60 (i.e. the inner bags 84L, 84R) includes two inner bags 84L1, 84L2/84R1, 84R2 each of which is configured to be inflated by the inflation gas fed from the gas generator 20.

The outer bag 80 is formed of a woven fabric, non-woven fabric or the like having flexibility, and is formed into a bag having the same shape as the airbag 40 in the first exemplary embodiment. The outer bag 80 includes a left portion 81L and a right portion 81R that cover the left and right inflatable portions 55, 60 (i.e. inner bags 84L, 84R), respectively, and a central portion 82 that has a small width between the inflatable portions 55, 60 (i.e. inner bags 84L, 84R). The central portion 82 includes, in the upper edge, an opening 82 that allows protrusion of later-described gas inlet sections 85 of the inner bags 84L1, 84L2, 84R1, 84R2.

Each of the inner bags 84L, 84R is formed of a woven fabric of polyester or the like, similarly to the airbag 40 of the first exemplary embodiment. Each of the inner bags 84L1, 84L2, 84R1, 84R2 includes a terminal inflatable portion 86 at the leading end. Each of the inner bags 84L, 84R is configured such that the two terminal inflatable portions 86 are disposed side by side inside the left portion 81L/right portion 81R of the outer bag 80 at airbag deployment for covering the targeted body part 3L/3R. That is, the terminal inflatable portion 86 of the inner bag 84L1 and the terminal inflatable portion 86 of the inner bag 84L2 are disposed side by side in a left and right direction inside the left portion 81L of the outer bag 80 at airbag deployment and constitute the left hip-protecting portion 58 in combination, and the terminal inflatable portion 86 of the inner bag 84R1 and the terminal inflatable portion 86 of the inner bag 84R2 are disposed side by side in a left and right direction inside the right portion 81R of the outer bag 80 and constitute the right hip-protecting portion 63 in combination. Each of the inner bags 84L1, 84L2, 84R1, 84R2 includes, in the base portion apart from the terminal inflatable portion 86, a gas inlet section 85. The four gas inlet sections 85 of the inner bags 84L1, 84L2, 84R1, 84R2 are let out of the outer bag 80 via the opening 82, and respectively connected to branched outlet ports 87*a* of a diffuser 87 to introduce the inflation gas G from the gas discharge portion 20*b* of the gas generator 20 into the inner bags 84L1, 84L2, 84R1, 84R2.

If the wearer 1 wearing the wearable airbag device 10G in accordance with the eighth exemplary embodiment falls, the operation control device 17 actuates the gas generator 20 to inflate the airbag 40G in response to a signal from the sensor part 18 having sensed the fall. The inflation gas G fed from the gas generator 20 flows into each of the inner bags 84L1, 84L2, 84R1, 84R2 and inflates the inner bags 84L (84L1, 84L2), 84R (84R1, 84R2). When the airbag 40G is fully inflated, the terminal inflatable portion 86 of each of the inner bags 84L1, 84L2, 84R1, 84R2 are disposed side by side inside the left portion 81L/right portion 81R of the outer bag 80 and protect the targeted body parts 3L/3R in such a manner as to surround the targeted body parts 3L/3R. This configuration that a plurality of terminal inflatable portions 86 each having a small diameter are arranged side by side will contribute to reduction of volume of each of the inflatable portions 55, 60 while keeping protecting performance, compared to an instance where a single inflatable portion inflatable in the shape of a circular column is to cover the targeted body part. As a consequence, a gas generator with a small output will work as the gas generator 20 of the wearable airbag device 10G. Moreover, since the terminal inflatable portions 86 of the inner bags 84L1, 84L2, 84R1, 84R2 are configured to be inflated inside the left portion 81L/right portion 81R of the outer bag 80, the terminal inflatable portions 86 will be deployed precisely at predetermined positions for covering the targeted body parts 3L, 3R.

Therefore, the wearable airbag device 10G in accordance with the eighth exemplary embodiment only needs a small and light gas generator to inflate the airbag 40G.

In the airbag 40G, two each of the inner bags 84L1, 84L2/84R1, 84R2 are stored in the left portion 81L/the right portion 81R of the outer bag 80, respectively, as the inflatable portion 55/60. Alternatively, three or more inner bags may form each of the inflatable portions.

Figure 26:
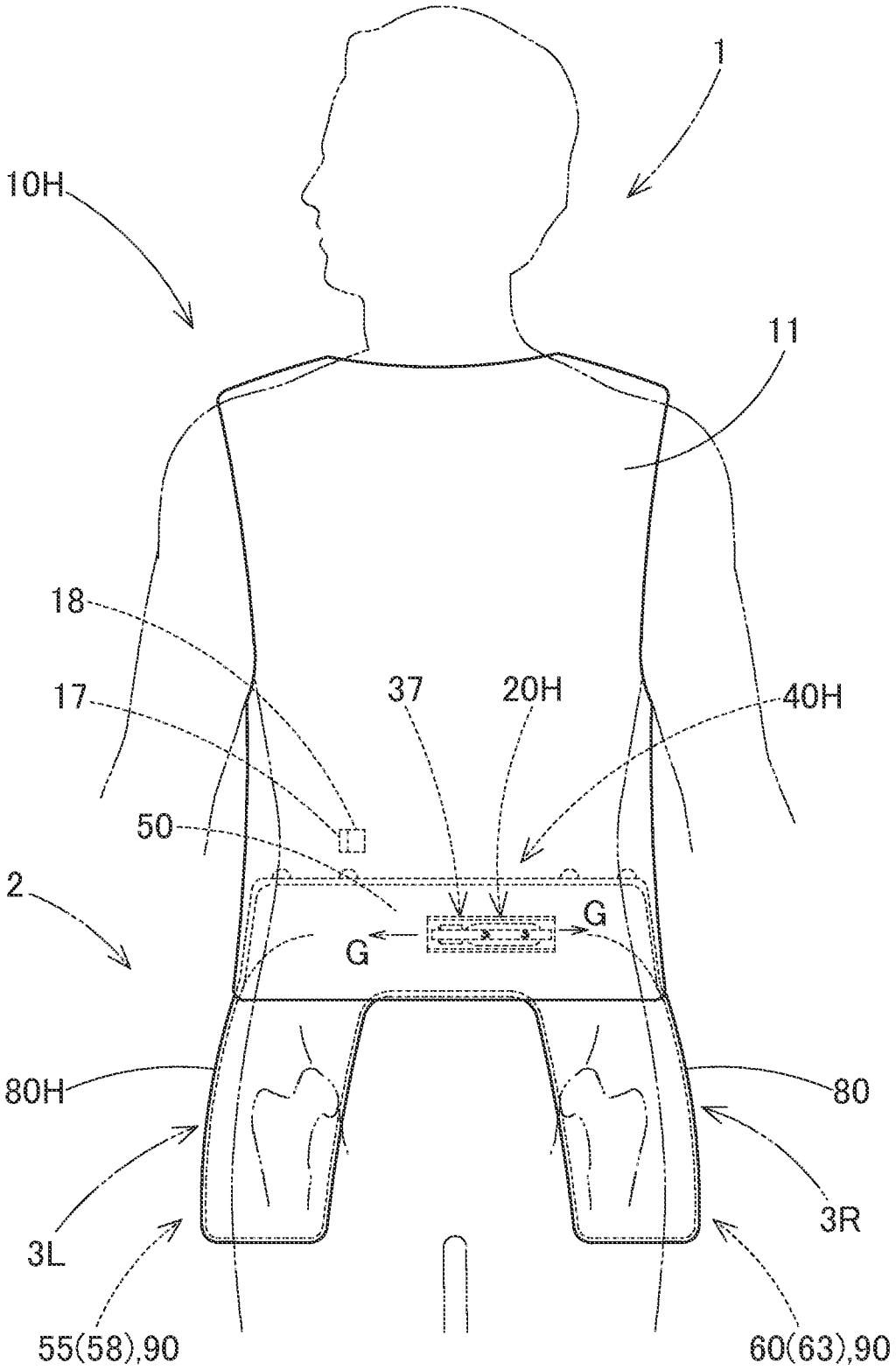
FIG. 26 is a schematic back view of a wearable airbag device in accordance with the ninth exemplary embodiment as actuated.
Figure 27A:
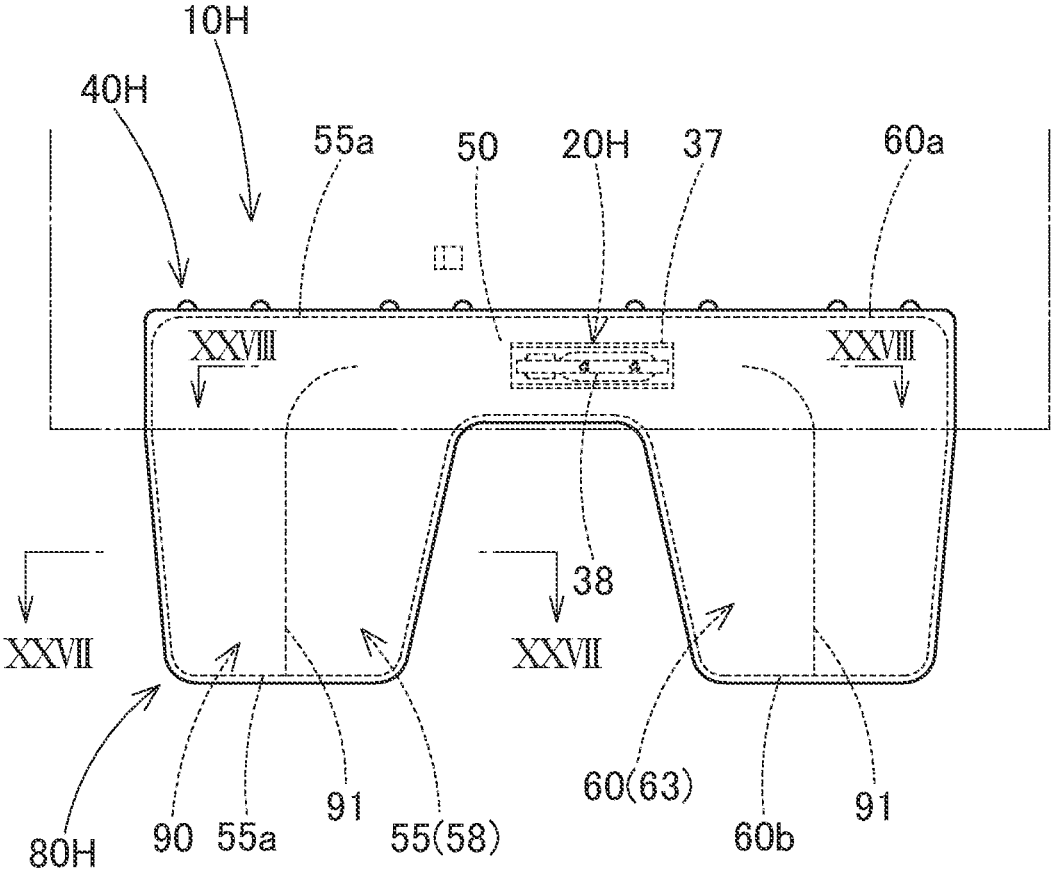
FIG. 27A is a schematic back view of the wearable airbag device in accordance with the ninth exemplary embodiment.
Figure 27B:
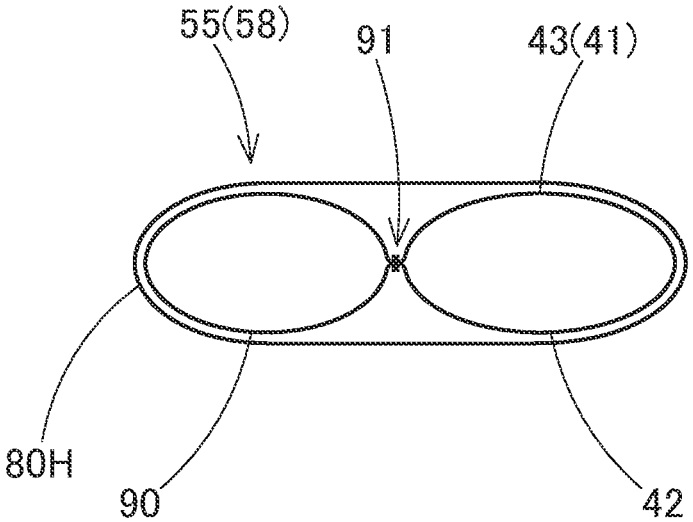
FIG. 27B is a schematic sectional end view taken along line XXVII-XXVII of FIG. 27A.
Figure 28:
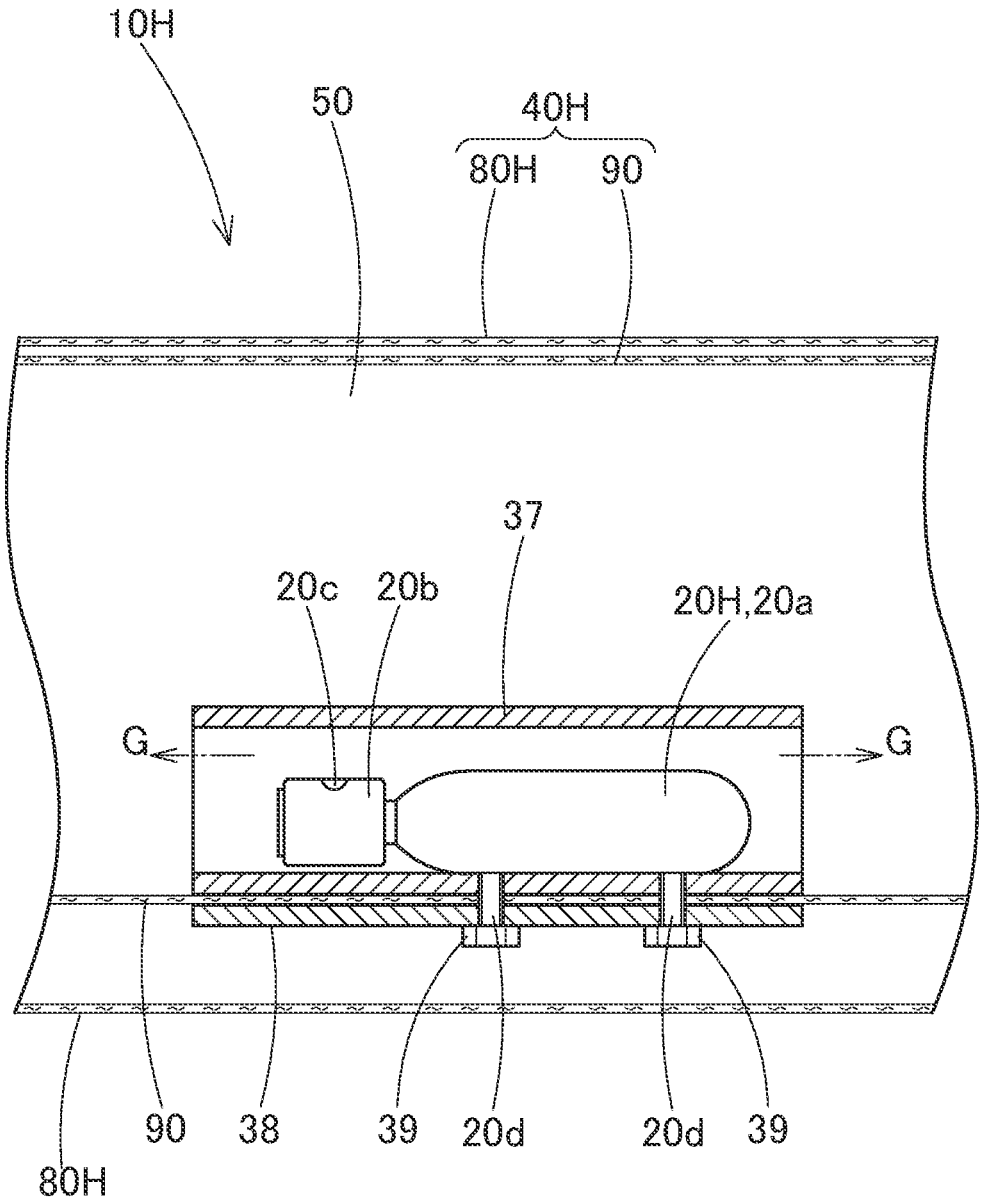
FIG. 28 is a schematic cross-sectional view taken along line XXVIII-XXVIII of FIG. 27A.

A wearable airbag device 10H in accordance with the ninth exemplary embodiment is now described referring to FIGS. 26 to 28. In the wearable airbag device 10H in accordance with the ninth embodiment, the gas generator 20H is stored inside the airbag 40H.

In the wearable airbag device 10H, the airbag 40H includes an outer bag 80H and an inner bag 90 stored inside the outer bag 80H. The inner bag 90 includes the left and right inflatable portions 55, 60 and a connecting portion 50 that is disposed between the inflatable portions 55, 60 and has a narrow width. Each of the inflatable portions 55, 60 includes a left/right hip-protecting portion 58/63. Each of the inflatable portions 55, 60 includes a jointed portion 91 in which the outer wall 42 and the inner wall 43 of the outer shell 41 of the inflatable portion 55/60 are jointed together. The jointed portion 91 of each of the inflatable portions 55, 60 is composed of a seam of the outer wall 42 and inner wall 43 that extends from the connecting portion 50 to a vicinity of a center in a left and right direction of the lower edge 55*b*/60*b* of the inflatable portion 55/60.

Referring to FIG. 28, the gas generator 20H is stored in and fixed to the inner bag 90 with the use of a retainer 37, which is formed of metal into a substantially circular cylinder, and a holding plate 38. The gas generator 20H includes a main body 20*a*, a gas discharge portion 20*b* that includes a discharge port 20*c* configured to discharge an inflation gas G, and two bolts 20*d* that protrude outwardly from the main body 20*a*. The main body 20*a* and the gas discharge portion 20*b* is housed inside the retainer 37, then the retainer 37 in that state is stored inside the connecting portion 50 of the inner bag 90 so that the bolts 20*d* go through the retainer 37 and inner bag 90 outwardly. The holding plate 38 is applied to the retainer 37 from outside of the inner bag 90, then nuts 39 are fastened with the bolts 20*d*. Thus the gas generator 20H is stored in and fixed to the inner bag 90.

The wearable airbag device 10H in accordance with the ninth embodiment is formed by mounting the airbag 40H as housing the gas generator 20H and the operation control device 17 on the holding body 11. If the wearer 1 wearing the wearable airbag device 10H falls, the operation control device 17 actuates the gas generator 20H to inflate the airbag 40H in response to a signal from the sensor part 18 having sensed the fall. The inner bag 90 is inflated with the inflation gas G and the hip-protecting portions 58, 63 cover and protect the sides of the trochanters 3L, 3R of femur (i.e. the targeted body parts), as can be seen in FIG. 26.

In the wearable airbag device 10H, since the gas generator 20H itself is stored inside the inner bag 90 of the airbag 40H, the inflation gas G will hardly leak to the outside of the airbag 40H (or inner bag 90), so that the gas generator 20H is able to inflate the inflatable portions 55, 60 effectively. Accordingly, the gas generator only needs to have an output corresponding to the volumes of the inflatable portions 55, 60. In other words, the gas generator need not have an output higher than necessary.

Therefore, the wearable airbag device 10H in accordance with the ninth exemplary embodiment only needs a small and light gas generator to inflate the airbag 40H.

In the wearable airbag device 10H in accordance with the ninth exemplary embodiment, moreover, the airbag 40H includes the outer bag 80H and the inner bag 90 that is stored inside the outer bag 80H and includes a plurality of inflatable portions 55, 60 configured to be inflated with an inflation gas G fed from the gas generator 20H. The inflatable portions 55, 60 respectively include the left hip-protecting portion 58 that is adapted to cover the left side of the hip 2 of the wearer 1 and the right hip-protecting portion 63 that is adapted to cover the right side of the hip 2 of the wearer 1. The gas generator 20H is disposed in and attached to the region (i.e. the connecting portion 50) of the inner bag 90 disposed between the left and right hip-protecting portions 58, 63 so as to feed the inflation gas G both to the left and right hip-protecting portions 58, 63 when actuated.

When the wearable airbag device 10H in accordance with the ninth exemplary embodiment is actuated, the gas generator 20H is able to feed the inflation gas G both to the left and right hip-protecting portions 58, 63 quickly, so that the hip-protecting portions 58, 63 are able to protect the left and right sides of the hip 2 of the wearer 1 quickly. Moreover, since the gas generator 20H is attached to the inner bag 90 which is stored inside the outer bag 80H, it does not need to be mounted on the holding body 11.

Although the airbag 40H in the ninth exemplary embodiment has a double-layer structure of the outer bag 80H and inner bag 90, the gas generator 20H may also be stored in an airbag having a single-layer structure. By way of example, the gas generator may be stored inside the connecting portion 50 of the airbag 40C, 40D, 40E of the fourth, fifth, and sixth exemplary embodiment, with the use of a retainer 37 and a holding plate 38.

Figure 29:
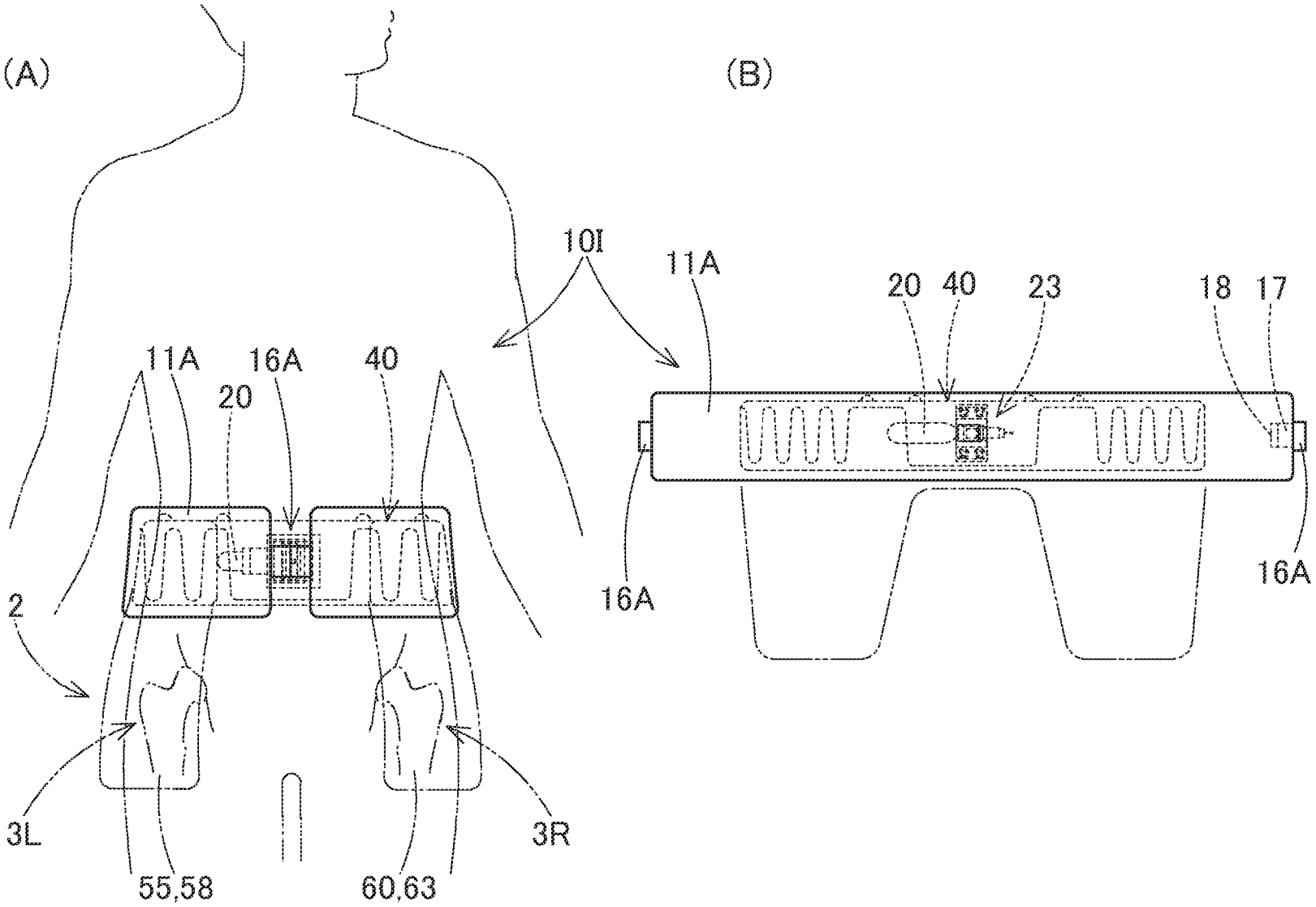
FIG. 29 depicts a modification of the holding body as worn by the wearer and the modification as laid flat.

In the first and second exemplary embodiments, the holding body 11 that holds the airbag 40 and so on is formed into a vest. Alternatively, the holding body 11 may be formed into a jacket with sleeves, or may also be formed into a belt, like a holding body 11A depicted in FIG. 29. The holding body 11A includes a fastening member 16A such as a hook-and-loop fastener for fastening the left and right ends together so as to be wearable around the hip 2.

A first wearable airbag device of the present disclosure is adapted to be worn by a wearer and configured to be actuated at fall of the wearer. The wearable airbag device includes: a gas generator; an airbag that includes a plurality of inflatable portions that are partitioned from one another, the plurality of inflatable portions each including a gas inlet port and being configured to be inflated with an inflation gas fed from the gas generator via the gas inlet port for protecting a targeted body part of the wearer; and a gas switching mechanism that is disposed in a pathway of the inflation gas from the gas generator toward the plurality of inflatable portions, the gas switching mechanism being configured to switch a destination of the inflation gas emitted from the gas generator over to only one inflatable portion disposed in a falling direction of the wearer out of the plurality of inflatable portions.

In operation of the wearable airbag device in accordance with the first exemplary embodiment, due to operation of the gas switching mechanism, the inflation gas flows only into the one inflatable portion disposed in the falling direction of the wearer out of the plurality of inflatable portions, so that this inflatable portion secures a predetermined internal pressure and is deployed between the targeted body part and the ground to protect the body part. Since the plurality of inflatable portions are partitioned from one another and the inflation gas does not flow into other inflatable portions, the gas generator does not need to have a gas output for inflating all the inflatable portions, but only has to have a gas output enough to inflate the one inflatable portion. That is, a small and light gas generator will work as the gas generator for the wearable airbag device in accordance with the first exemplary embodiment.

Therefore, the first wearable airbag device of this disclosure is able to protect the targeted body part with the airbag and the gas generator which is small and light in weight.

In one or more embodiments, the gas switching mechanism may include: a gas exit section that includes a plurality of gas outlet ports corresponding in number to the number of the plurality of inflatable portions, the plurality of gas outlet ports each being in gas communication with the gas inlet port of a corresponding one of the plurality of inflatable portions of the airbag; a slidable portion that is disposed on a side of the gas exit section facing away from the airbag, the slidable portion including a communication port and a peripheral portion of the communication port, the slidable portion being configured to slide against the gas exit section in the falling direction of the wearer due to gravity so as to bring the communication port into gas communication with one of the plurality of gas outlet ports of the gas exit section while closing remaining gas outlet ports of the gas exit section with the peripheral portion of the communication port; a stopper that, at sliding movement of the slidable portion in the falling direction, is configured to position the slidable portion at a position where the communication port of the slidable portion is in gas communication with one of the gas outlet ports of the gas exit section that is in gas communication with the gas inlet port of the one inflatable portion disposed in the falling direction; and a gas entrance section that covers the communication port of the slidable portion on a side of the slidable portion facing away from the gas exit section, the gas entrance section having gas communication with a portion of the gas generator configured to discharge the inflation gas, and being configured to lead the inflation gas into the communication port of the slidable portion.

With the wearable airbag device configured as described above, when the wearer wearing the wearable airbag device falls, the gas generator emits an inflation gas, and at the same time, the slidable portion slides in the falling direction against the gas exit section and is positioned by the stopper at the position where the communication port opens one of the gas outlet ports of the gas exit section which is in gas communication with the inlet port of the inflatable portion in the falling direction. Accordingly, the inflation gas from the gas generator flows only into the inflatable portion in the falling direction via the gas entrance section, the communication port of the slidable section, the gas outlet port of the gas exit section, and the inlet port of the inflatable portion, and protects the targeted body part of the wearer from the ground. With this configuration, the destination of the inflation gas is switched only by the sliding movement of the slidable portion due to gravity, without using a sensor for sensing the falling direction and determining means.

In one or more embodiments, the wearable airbag device may be configured to include an operation control device that is configured to control operation of the gas generator and operation of the gas switching mechanism, wherein the operation control device includes a sensor part that is configured to sense the falling direction of the wearer, and wherein the operation control device is configured to operate the gas switching mechanism to switch the destination of the inflation gas based on the falling direction sensed by the sensor part.

With the above configuration, the redirection of gas flow will be conducted steadily because it does not rely on mechanical operation due to gravity.

In one or more embodiments, the plurality of inflatable portions of the airbag may include a left hip-protecting portion that is adapted to cover the left side of the hip of the wearer, a right hip-protecting portion that is adapted to cover the right side of the hip of the wearer, and a head-protecting portion that is adapted to cover the back of the head of the wearer.

In one or more embodiments, the plurality of inflatable portions of the airbag may include only a left hip-protecting portion that is adapted to cover the left side of the hip of the wearer and a right hip-protecting portion that is adapted to cover the right side of the hip of the wearer.

A second wearable airbag device of this disclosure that is adapted to be worn by a wearer and configured to be actuated at fall of the wearer includes a gas generator, and an airbag that includes a plurality of inflatable portions each of which is configured to be inflated with an inflation gas fed from the gas generator for protecting a targeted body part of the wearer. The plurality of inflatable portions each includes a thickness-regulating means that limits a thickness of the inflatable portion as inflated.

The thickness-regulating means will help inflate each of the plurality of inflatable portions into a board shape, not in a spherical shape. Therefore, each of the inflatable portions will be able to cover the respective targeted body part widely and adequately. Since each of the inflatable portions is configured to be inflated into a board shape having a limited volume, the gas generator for inflating the airbag does not need to have a high output.

Therefore, the second wearable airbag device only needs a small and light gas generator to inflate the airbag.

In one or more embodiments, the thickness-regulating means may be composed of a jointing element that joints opposing portions of an outer shell of the airbag together in a state where the opposing portions are brought close to one another.

The jointing element may be composed of a seam in which opposing portions of an outer shell of the airbag are jointed together partially and directly, or a tether that joints opposing portions of an outer shell of the airbag indirectly. Further alternatively, the jointing element may be composed of a closing portion that joints opposing portions of an outer shell of the airbag together at an outer circumferential edge of the inflatable portion in order to define an outer shape of the inflatable portion in a direction perpendicular to the thickness direction of the inflatable portion. Such jointing element will help reduce the volume of each of the inflatable portions and inflate the inflatable portions effectively to cover the targeted body parts.

In one or more embodiments, the plurality of inflatable portions of the airbag may include a left hip-protecting portion and a right hip-protecting portion that are adapted to cover the left side and right side of the hip of the wearer, respectively, and each of the left and right hip-protecting portions may be configured such that a portion thereof that is adapted to be deployed over the trochanter of femur is greater in thickness than a portion adjoining thereto when inflated.

The airbag configured as described above will be able to adequately cover the left and right trochanters of femur which would require special protection.

A third wearable airbag device of this disclosure that is adapted to be worn by a wearer and configured to be actuated at fall of the wearer includes a gas generator and an airbag that includes an outer bag and a plurality of inflatable portions that are stored in the outer bag. The plurality of inflatable portions is each configured to be inflated with an inflation gas fed from the gas generator for protecting a targeted body part of the wearer. Each of the inflatable portions includes a plurality of inner bags each of which is configured to be inflated with the inflation gas fed from the gas generator. The plurality of inner bags each includes a terminal inflatable portion in a vicinity of a leading end thereof so that the terminal inflatable portions of the plurality of inner bags are disposed side by side at airbag deployment in order to protect the targeted body part in each of the plurality of inflatable portions.

When the third wearable airbag device of the present disclosure is actuated and the inflatable portions are inflated inside the outer bag, the terminal inflatable portions of each of the inflatable portions are disposed side by side inside the outer bag and protect the targeted body parts in such a manner as to surround the targeted body parts. This configuration that the terminal inflatable portions each having a small diameter are arranged side by side will contribute to reduction of volume of each of the inflatable portions while keeping protecting performance, compared to an instance where a single inflatable portion inflatable in the shape of a circular column is to cover the targeted body part. As a consequence, a gas generator with a small output will work as the gas generator of the above wearable airbag device. Moreover, since the terminal inflatable portions of each of the inflatable portions are configured to be inflated inside the outer bag, the terminal inflatable portions will be deployed precisely at predetermined positions for covering the targeted body part.

Therefore, the third wearable airbag device of this disclosure only needs a small and light gas generator as the gas generator for inflating the airbag.

A fourth wearable airbag device that is adapted to be worn by a wearer and configured to be actuated at fall of the wearer includes a gas generator and an airbag that includes a plurality of inflatable portions each of which is configured to be inflated with an inflation gas fed from the gas generator for protecting a targeted body part of the wearer. The gas generator is stored inside the airbag.

In the wearable airbag device described above, since the gas generator itself is stored inside the airbag, the inflation gas will hardly leak to the outside of the airbag, so that the gas generator is able to inflate the inflatable portions effectively. Accordingly, the gas generator only needs to have an output corresponding to the volumes of the inflatable portions. In other words, the gas generator need not have an output higher than necessary.

Therefore, the fourth wearable airbag device of the present disclosure only needs a small and light gas generator to inflate the airbag.

In one or more embodiments, the airbag of the fourth wearable airbag device may be configured to include an outer bag and an inner bag that is stored inside the outer bag and includes the plurality of inflatable portions, the plurality of inflatable portions including a left hip-protecting portion that is adapted to cover the left side of the hip of the wearer and a right hip-protecting portion that is adapted to cover the right side of the hip of the wearer. The gas generator may be disposed in and mounted on a region of the inner bag located between the left and right hip-protecting portions so as to feed the inflation gas both to the left and right hip-protecting portions when actuated.

When the wearable airbag device configured as described above is actuated, the gas generator will be able to feed the inflation gas both to the left and right hip-protecting portions quickly, so that the hip-protecting portions will be able to protect the left and right sides of the hip of the wearer quickly. Moreover, since the gas generator has been already attached to the inner bag which is stored inside the outer bag, it does not need to be mounted on the holding body.

What is claimed is:

1. A wearable airbag device adapted to be worn by a wearer and configured to be actuated at fall of the wearer, the wearable airbag device comprising:

a gas generator;

an airbag that includes a plurality of inflatable portions that are partitioned from one another, the plurality of inflatable portions each including a gas inlet port and being configured to be inflated with an inflation gas fed from the gas generator via the gas inlet port for protecting a targeted body part of the wearer; and a gas switching mechanism that is disposed in a pathway of the inflation gas from the gas generator toward the plurality of inflatable portions, the gas switching mechanism being configured to switch a destination of the inflation gas emitted from the gas generator over to only one inflatable portion disposed in a falling direction of the wearer out of the plurality of inflatable portions, wherein the gas switching mechanism includes:

a gas exit section that includes a plurality of gas outlet ports corresponding in number to the number of the plurality of inflatable portions, the plurality of gas outlet ports each being in gas communication with the gas inlet port of a corresponding one of the plurality of inflatable portions of the airbag;

a slidable portion that is disposed on a side of the gas exit section facing away from the airbag, the slidable portion including a communication port and a peripheral portion of the communication port, the slidable portion being configured to slide against the gas exit section due to gravity in the falling direction of the wearer so as to bring the communication port into gas communication with one of the plurality of gas outlet ports of the gas exit section while closing remaining gas outlet ports of the gas exit section with the peripheral portion of the communication port;

a stopper that, at sliding movement of the slidable portion in the falling direction, is configured to position the slidable portion at a position where the communication port of the slidable portion is in gas communication with one of the plurality of gas outlet ports of the gas exit section that is in gas communication with the gas inlet port of the one inflatable portion disposed in the falling direction; and a gas entrance section that covers the communication port of the slidable portion on a side of the slidable portion facing away from the gas exit section, the gas entrance section having gas communication with a portion of the gas generator configured to discharge the inflation gas, and being configured to lead the inflation gas into the communication port of the slidable portion.

2. The wearable airbag device of claim 1, wherein the plurality of inflatable portions includes a left hip-protecting portion and a right hip-protecting portion that are adapted to cover the left side and right side of the hip of the wearer, respectively.

* * * * *